US010037634B2

(12) United States Patent
Christofferson et al.

(10) Patent No.: US 10,037,634 B2
(45) Date of Patent: Jul. 31, 2018

(54) SYSTEM AND METHOD FOR IDLE STATE DETERMINATION

(71) Applicant: Deere & Company, Moline, IL (US)

(72) Inventors: Craig A. Christofferson, Dubuque, IA (US); Keith N. Chaston, Dubuque, IA (US); Madeline T. Oglesby, Asbury, IA (US); Todd F. Velde, Dubuque, IA (US); Francois Stander, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 175 days.

(21) Appl. No.: 15/077,606

(22) Filed: Mar. 22, 2016

(65) Prior Publication Data

US 2017/0278315 A1 Sep. 28, 2017

(51) Int. Cl.

| | |
|---|---|
| ***G07C 5/02*** | (2006.01) |
| ***G07C 5/00*** | (2006.01) |
| ***G07C 5/08*** | (2006.01) |

(52) U.S. Cl.

CPC ..... *G07C 5/02* (2013.01); *G07C 5/008* (2013.01); *G07C 5/0825* (2013.01)

(58) Field of Classification Search

CPC ..... G07C 5/008; G07C 5/0825; G07C 5/02; F02D 41/08; E02F 9/2025

See application file for complete search history.

(56) References Cited

U.S. PATENT DOCUMENTS

| | | | | |
|---|---|---|---|---|
| 4,338,512 | A | 7/1982 | Ludwig | |
| 5,327,347 | A | 7/1994 | Hagenbuch | |
| 7,894,961 | B2 | 2/2011 | Blackburn et al. | |
| 2009/0234563 | A1 * | 9/2009 | Pfohl | E02F 9/2246 701/112 |
| 2012/0084047 | A1 | 4/2012 | Vesterdal et al. | |
| 2013/0282242 | A1 * | 10/2013 | Park | F02D 29/02 701/50 |
| 2014/0371982 | A1 * | 12/2014 | Borst | B60W 10/06 701/36 |

(Continued)

FOREIGN PATENT DOCUMENTS

| | | | |
|---|---|---|---|
| CA | 2810584 | A1 | 5/2013 |
| CA | 2815241 | A1 | 5/2013 |
| EP | 0162608 | A1 | 11/1985 |

*Primary Examiner* — Mussa A Shaawat

(74) *Attorney, Agent, or Firm* — Klintworth & Rozenblat IP LLP

(57) ABSTRACT

An idle state determination system and method are disclosed for a work vehicle having an engine and at least one movable work implement. The movable work implement includes a load bin. The idle state determination system includes a source of work vehicle data that indicates one or more operational parameters of the work vehicle, including at least a speed, a state of an engine and a position of the load bin. The idle state determination system including a source of idle state classifications that include a plurality of idle states associated with the work vehicle, and the plurality of idle states including at least a waiting idle state and a loading idle state. The idle state determination system includes a controller that processes the work vehicle data to determine an idle state of the work vehicle. The controller classifies the idle state as one of the plurality of idle states.

20 Claims, 18 Drawing Sheets

(56) References Cited

U.S. PATENT DOCUMENTS

| | | | | |
|---|---|---|---|---|
| 2015/0039187 | A1* | 2/2015 | Friebel | E02F 9/2246 701/50 |
| 2015/0342118 | A1 | 12/2015 | Corbett et al. | |
| 2017/0037825 | A1* | 2/2017 | Chung | F02N 11/0822 |

* cited by examiner

SYSTEM AND METHOD FOR IDLE STATE DETERMINATION

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles and the determination of an idle state of the work vehicle.

BACKGROUND OF THE DISCLOSURE

In the construction industry, various work machines, such as an articulated dump truck, may be utilized in the hauling of payload over rough terrain. In certain instances, during the operation of the articulated dump truck, the articulated dump truck may be in an idle state. In the example of an articulated dump truck being used to load and unload a payload, these idle states can increase a cycle time associated with the loading and unloading cycle. Moreover, these idle states can result in increased fuel consumption by the articulated dump truck.

In many instances, an owner or a worksite manager may be unaware of the idle time associated with the articulated dump truck. Moreover, the owner or the worksite manager may be unaware of the fuel consumption during idle states.

SUMMARY OF THE DISCLOSURE

The disclosure provides a system and method for determining an idle state of a work vehicle.

In one aspect the disclosure provides an idle state determination system for a work vehicle having an engine and at least one movable work implement. The movable work implement includes a load bin movable between loaded and unloaded positions by a hydraulic circuit, and the load bin is operable to receive a payload. The idle state determination system includes a source of work vehicle data that indicates one or more operational parameters of the work vehicle. The operational parameters include at least a speed of the work vehicle, a state of the engine and a position of the load bin. The idle state determination system including a source of idle state classifications that include a plurality of idle states associated with the work vehicle, and the plurality of idle states including at least a waiting idle state and a loading idle state. The idle state determination system includes a controller that receives and processes the work vehicle data to determine an idle state of the work vehicle. The controller classifies the determined idle state as one of the plurality of idle states.

In another aspect the disclosure provides a method for determining an idle state for a work vehicle having an engine, a drivetrain and at least one movable work implement. The movable work implement includes a load bin movable between loaded and unloaded positions by a hydraulic circuit, and the load bin is operable to receive a payload. The method comprises: receiving one or more operational parameters associated with the work vehicle; determining, by a processor, a state of the work vehicle based on the operational parameters, the state of the work vehicle comprising one of a plurality of vehicle states including an engine off state, at least one of a stationary state and at least one of a transport state; determining, by the processor, a transition in the state of the work vehicle; determining, by the processor, an idle state based on the determined transition; and classifying, by the processor, the determined idle state based on one of a plurality of idle states associated with the work vehicle, the plurality of idle states including at least a warm-up idle state, a waiting to load idle state, a loading idle state, a waiting to dump idle state and a cool-down idle state.

In yet another aspect the disclosure provides an idle state determination system for a work vehicle having an engine and at least one movable work implement. The movable work implement includes a load bin movable between loaded and unloaded positions by a hydraulic circuit, and the load bin is operable to receive a payload. The idle state determination system includes a source of work vehicle data that indicates one or more operational parameters of the work vehicle. The operational parameters include at least a speed of the work vehicle, a state of the engine, a weight of the payload and a state of the load bin. The idle state determination system includes a source of idle state classifications that include a plurality of idle states associated with the work vehicle. The plurality of idle states include at least a warm-up idle state, a waiting to load idle state, a loading idle state, a waiting to dump idle state, a break time idle state and a cool-down idle state. The idle state determination system includes a controller that receives and processes the work vehicle data and is configured to: determine an idle state of the work vehicle based on the work vehicle data; classify the determined idle state as one of the plurality of idle states; determine a duration of the determined idle state based, at least in part, on the work vehicle data indicating a transition in at least one of the speed of the work vehicle, the weight of the payload and the state of the load bin; and transmit the duration for each of the plurality of idle states to a remote processing system.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
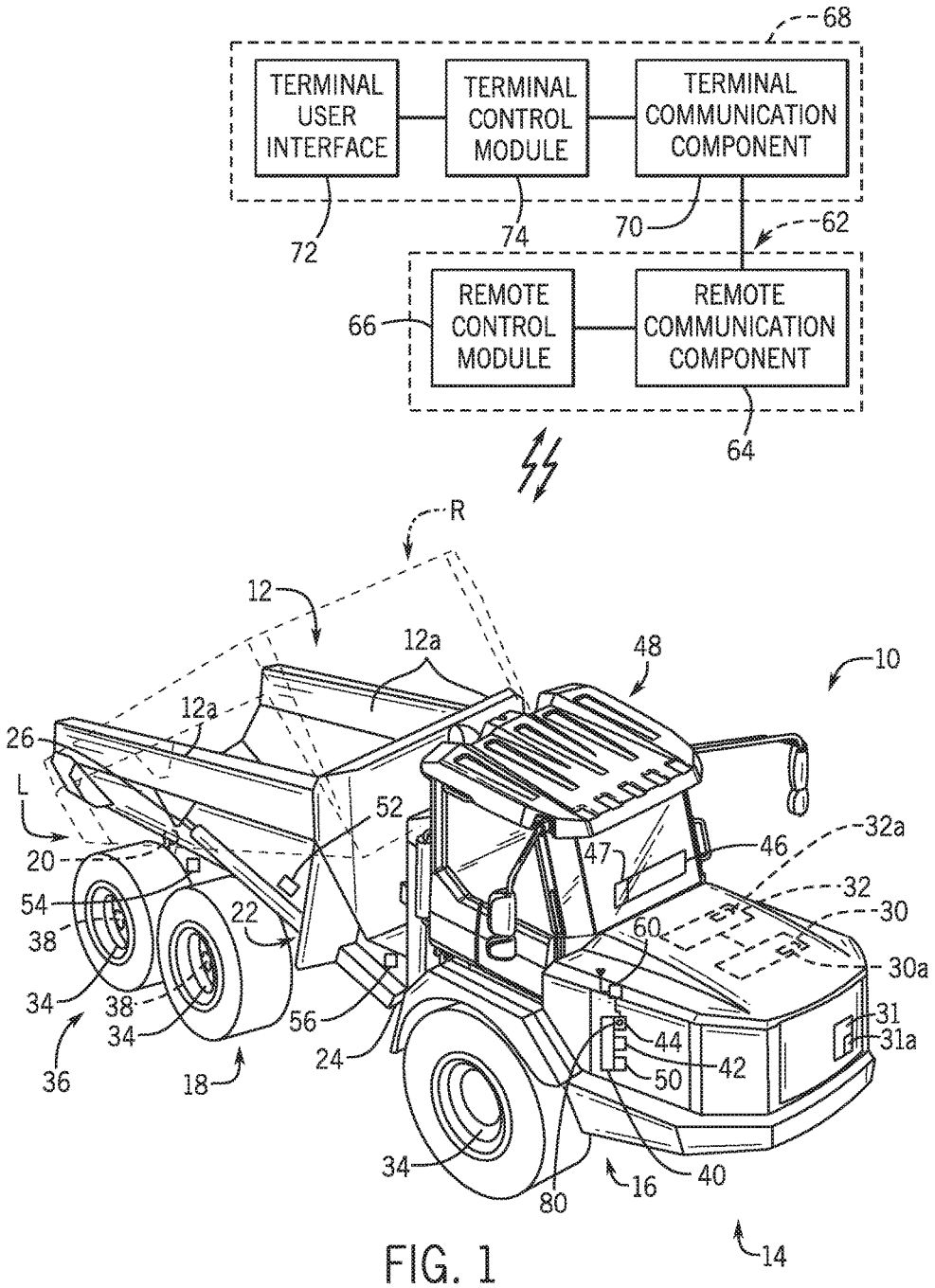
FIG. 1 is a perspective view of an example work machine in the form of an articulated dump truck in which the disclosed idle state determination system and method may be used.

The following describes one or more example embodiments of the disclosed system and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the articulated dump truck described herein is merely one exemplary embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The following describes one or more example implementations of the disclosed system for idle state determination, as shown in the accompanying figures of the drawings described briefly above. Generally, the disclosed systems (and work vehicles in which they are implemented) provide for the determination of an idle state of the work vehicle, which enables an operator or an owner of the work vehicle to identify when the work vehicle is inactive. By identifying the idle states of the work vehicle, the owner or operator can implement procedures to reduce idle time, for example, by introducing additional work vehicles, removing work vehicles to reduce waiting idle times, reducing unexpected break times by the operators, etc.

Generally, the following description relates to a work vehicle as an articulated dump truck having a load bin that is movable with respect to a work vehicle (or other work machine) by various actuators in order to accomplish tasks with the load bin. Discussion herein may sometimes focus on the example application of moving a load bin configured as a dump bin for an articulated dump truck, with actuators for moving the load bin generally configured as hydraulic cylinders. In other applications, other configurations are also possible. In some embodiments, for example, the load bin may be fixed or not movable relative to the work vehicle. Likewise, work vehicles in some embodiments may be configured as haulers or loaders, such as tractor loaders, crawler loaders or similar machines, or in various other ways.

Generally, the idle state determination system and method of the present disclosure determines one or more vehicle states, and based on transitions in the determined vehicle states, determines one or more idle states. It should be noted, however, that the idle state determination system and method may determine idle states based on the inputs or operational parameters used to identify the one or more vehicle states, and thus, the following implementation of the idle state determination system is merely exemplary.

In this example, based on operational parameter data associated with the work vehicle, such as a speed of the work vehicle, a position of the load bin, an input command to move the load bin, a state of an engine of the work vehicle, a weight of a payload in the work vehicle, and so on, the idle state determination system determines one or more vehicle states. The one or more vehicle states can include: engine off vehicle state, a stationary laden vehicle state, a stationary semi-laden vehicle state, a stationary unladen vehicle state, a stationary dumping vehicle state, a transport laden vehicle state, a transport semi-laden vehicle state, a transport unladed vehicle state, a transport dumping vehicle state and an invalid input vehicle state. It should be noted, however, that these vehicle states are merely exemplary as the work vehicle can include additional, fewer or different vehicle states.

Based on a transition between a previous vehicle state and a current vehicle state, the idle state determination system determines a start of an idle state. Based on the previous vehicle state and the current vehicle state, the idle state determination system classifies the idle state into one of a plurality of idle states associated with the work vehicle. In one example, the plurality of idle states can include: a warm-up idle state classification, a waiting to load idle state classification, a loading idle state classification, a wait during haul idle state classification, a waiting to dump idle state classification, a wait during return idle state classification, a break time idle state classification and a cool down idle state classification. Based on a subsequent transition from the current vehicle state, to another, different current vehicle state, the idle state determination system determines an end of the idle state, and determines a duration of the idle state. The idle state determination system repeats the determination of the one or more vehicle states, the determination of the one or more idle states, the classification of the one or more idle states and the determination of the duration for each determined idle state over a period of operation of the work vehicle. The idle state determination system compiles the determined idle states and the associated durations, and transmits this data to a remote processing system. The idle state determination system can also receive as input a level of fuel in a fuel tank associated with the work vehicle, and can determine a fuel consumption (via the changes in the level of fuel in the fuel tank) over the period of operation of the work vehicle. The idle state determination system can also output the fuel consumption to the remote processing system.

The remote processing system receives the data from the work vehicle, which includes the complied idle state data, the duration for each of the determined idle states, the fuel consumption and optionally the one or more determined vehicle states, and can generate one or more graphical user interfaces for display on a remote terminal user interface of a remote terminal device in communication with the remote processing system. The one or more graphical user interfaces can provide a visual and/or textual indicator of an amount of time spent by the work vehicle in each of the determined idle states (based on the duration of the determined idle states). The one or more graphical user interfaces can also provide a visual and/or textual indicator of an amount of fuel consumed by the work vehicle in each of the determined idle states (based on the duration of the determined idle states and the fuel consumption data).

As noted above, the disclosed idle state determination system may be utilized with regard to various machines with load bins, including articulated dump trucks and other machines for hauling a payload. Referring to FIG. 1, in some embodiments, the disclosed idle state determination system can be used with an articulated dump truck (ADT) 10 to determine one or more idle states associated with the operation of the ADT 10. In one example, the ADT 10 includes a load bin 12 mounted to a vehicle frame 14. It will be understood that the configuration of the ADT 10 is presented as an example only.

In the embodiment depicted, the vehicle frame 14 includes a first, front frame portion 16 and a second, rear frame portion 18, which are coupled together via an articulation joint (not shown) to enable pivotal movement between the front frame portion 16 and the rear frame portion 18. The load bin 12 is mounted to the rear frame portion 18 via coupling pins 20 that define a pivot point for the load bin 12. The load bin 12 includes one or more walls 12*a*, which cooperate to define a receptacle to receive a payload. The load bin 12 is generally rated to receive a certain amount of payload (i.e. a rated payload capacity).

One or more hydraulic cylinders 22 are mounted to the rear frame portion 18 and to the load bin 12, such that the hydraulic cylinders 22 may be driven or actuated in order to pivot the load bin 12 about the coupling pins 20. Generally, the ADT 10 includes two hydraulic cylinders 22, one on a left side of the load bin 12 and one on a right side of the load bin 12 in a forward driving direction of the ADT 10. It should be noted, however, that the ADT 10 may have any number of hydraulic cylinders, such as one, three, etc. Each of the hydraulic cylinders 22 includes an end mounted to the rear frame portion 18 at a pin 24 and an end mounted to the load bin 12 at a pin 26. As will be discussed, upon activation of the hydraulic cylinders 22, the load bin 12 may be moved from a lowered position L (FIG. 1) to a raised positon R (FIG. 1 in phantom) to dump a payload contained within the load bin 12.

Thus, in the embodiment depicted, the load bin 12 is pivotable vertically relative to a horizontal axis by the one or more hydraulic cylinders 22. In other configurations, other movements of a load bin may be possible. Further, in some embodiments, a different number or configuration of hydraulic cylinders or other actuators may be used.

Thus, it will be understood that the configuration of the load bin 12 is presented as an example only. In this regard, a load bin (e.g., the load bin 12) may be generally viewed as a receptacle that is pivotally attached to a vehicle frame. Similarly, a coupling pin (e.g., the coupling pins 20) may be generally viewed as a pin or similar feature effecting pivotal attachment of a load bin to a vehicle frame. In this light, a tilt actuator (e.g., the hydraulic cylinders 22) may be generally viewed as an actuator for pivoting a receptacle with respect to a vehicle frame.

The ADT 10 includes a source of propulsion, such as an engine 30. The engine 30 supplies power to a transmission 32. In one example, the engine 30 is an internal combustion engine, such as a diesel engine, that is controlled by an engine control module 30*a*. It should be noted that the use of an internal combustion engine is merely an example, as the propulsion device can be a fuel cell, an electric motor, a hybrid-gas electric motor, etc. In the example of an internal combustion engine as the engine 30, the engine 30 includes a source of fuel or fuel tank 31. The fuel tank 31 supplies fuel to the engine 30, via a fuel pump, for example. One or more level sensors 31*a* are disposed in the fuel tank 31 to observe a level of fuel in the fuel tank, and generate sensor signals based thereon. The one or more level sensors 31*a* are in communication with a controller 44 over a communication architecture that facilitates the transfer of data, power, etc., such as a CAN bus.

The transmission 32 transfers the power from the engine 30 to a suitable driveline coupled to one or more driven wheels 34 (and tires) of the ADT 10 to enable the ADT 10 to move. As is known to one skilled in the art, the transmission 32 can include a suitable gear transmission, which can be operated in a variety of ranges containing one or more gears, including, but not limited to a park range, a neutral range, a reverse range, a drive range, a low range, etc. A current range of the transmission 32 may be provided by a transmission control module 32*a* in communication with the controller 44, or may be provided by a sensor that observes a range shifter or range selection unit associated with the transmission 32, as known to one of skill in the art.

The ADT 10 includes a brake system 36, which is operable to slow or prevent the rotation of the driven wheels 34. Generally, the brake system 36 includes a park brake 38. The park brake 38 is actuatable by an operator, via a pedal, for example, to lock one or more of the driven wheels 34. In various examples, the park brake 28 is an air brake. In the example of an air brake, the pedal is in communication with a source of pressurized air and the actuation of the pedal causes the pressurized air to clamp a brake shoe against a brake drum of the respective one or more of the driven wheels 34. The park brake 38 is in communication with the controller 44, and transmits one or more signals to the controller 44 that indicate whether the park brake 38 is active or inactive.

The ADT 10 also includes one or more pumps 40, which may be driven by the engine 30 of the ADT 10. Flow from the pumps 40 may be routed through various control valves 42 and various conduits (e.g., flexible hoses) in order to drive the hydraulic cylinders 22. Flow from the pumps 40 may also power various other components of the ADT 10. The flow from the pumps 40 may be controlled in various ways (e.g., through control of the various control valves 42), in order to cause movement of the hydraulic cylinders 22, and thus, the load bin 12 relative to the vehicle frame 14. In this way, for example, a movement of the load bin 12 between the lowered position L and the raised position R can be implemented by various control signals to the pumps 40, control valves 42, and so on.

Generally, the controller 44 (or multiple controllers) may be provided, for control of various aspects of the operation of the ADT 10, in general. The controller 44 (or others) may be configured as a computing device with associated processor devices and memory architectures, as a hard-wired computing circuit (or circuits), as a programmable circuit, as a hydraulic, electrical or electro-hydraulic controller, or otherwise. As such, the controller 44 may be configured to execute various computational and control functionality with respect to the ADT 10 (or other machinery). In some embodiments, the controller 44 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 44 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 44 may be in electronic, hydraulic, mechanical, or other communication with various other systems or devices of the ADT 10 (or other machinery). For example, the controller 44 may be in electronic or hydraulic communication with various actuators, sensors, and other devices within (or outside of) the ADT 10, including various devices associated with the pumps 40, control valves 42, and so on. The controller 44 can communicate with other systems or devices (including other controllers) in various known ways, including via a CAN bus (not shown) of the ADT 10, via wireless or hydraulic communication means, or otherwise. An example location for the controller 44 is depicted in FIG. 1. It will be understood, however, that other locations are possible including other locations on the ADT 10, or various remote locations.

In some embodiments, the controller 44 can be configured to receive input commands and to interface with an operator via a human-machine interface 46, which can be disposed inside a cab 48 of the ADT 10 for easy access by the operator. The human-machine interface 46 may be configured in a variety of ways. In some embodiments, the human-machine interface 46 may include one or more joysticks, various switches or levers, one or more pedals, one or more buttons, a touchscreen interface that may be overlaid on a display 47, a keyboard, a speaker, a microphone associated with a speech recognition system, or various other human-machine interface devices.

Various sensors may also be provided to observe various conditions associated with the ADT 10. In some embodiments, various sensors 50 (e.g., pressure, flow or other sensors) may be disposed near the pumps 40 and control valves 42, or elsewhere on the ADT 10. For example, sensors 50 may include one or more pressure sensors that observe a pressure within the hydraulic circuit, such as a pressure associated with at least one of the one or more hydraulic cylinders 22. The sensors 50 may also observe a pressure associated with the pumps 40. In some embodiments, various sensors may be disposed near the load bin 12. For example, sensors 52 (e.g. load sensors) may be disposed on or coupled near the load bin 12 in order to measure parameters including the load in the load bin 12 and so on. In some embodiments, the sensors 52 may include onboard weight (OBW) sensors, etc. In addition, the sensors 52 may be coupled to various locations on the ADT 10, such as one or more struts (not shown) of the ADT 10, to measure a weight of a load of the ADT 10. Thus, the sensors 52 observe a weight or a load of the ADT 10, which may be indicative of the weight of the payload of the load bin 12 or the weight of the ADT 10, from which the weight of the payload of the load bin 12 may be extracted based on a known weight of an empty ADT 10.

It should be appreciated, however, that various other devices can be used to detect whether a payload is present within the load bin 12, in addition to or besides the use of load sensors. For example, the sensors 52 can comprise one or more accelerometers. In this example, the one or more accelerometers observe a condition of the load bin 12 and generate sensor signals based thereon. For example, the one or more accelerometers generate sensor signals upon the observance of a shock or bounce on the load bin 12, such as that caused by a payload being dropped into the load bin 12. Thus, in this example, the one or more accelerometers determine whether a payload is being loaded into the load bin 12.

Various sensors 54 may also be disposed on or near the rear frame portion 18 in order to measure parameters, such as an incline or slope of the rear frame portion 18, and so on. In some embodiments, the sensors 54 may include an inclinometer coupled to or near the rear frame portion 18, etc. In certain embodiments, the sensors 54 may be microelectromechanical sensors (MEMS) that observe a force of gravity and an acceleration associated with the ADT 10. In addition, various sensors 56 are disposed near the rear frame portion 18 in order to observe an orientation of the load bin 12 relative to the rear frame portion 18. In some embodiments, the sensors 56 include angular position sensors coupled between the rear frame portion 18 and the load bin 12 in order to detect the angular orientation of the load bin 12 relative to the rear frame portion 18.

In certain embodiments, one or more sensors 58 are coupled to the ADT 10 to observe a velocity or speed of the ADT 10 and generate sensor signals based thereon. In one example, the one or more sensors 58 comprise wheel speed sensors, which observe a speed of the driven wheels 34 and generate sensor signals based thereon. Based on the speed of the driven wheels 34, the controller 44 determines a speed of the ADT 10. It should be noted that in some embodiments, the speed of the ADT 10 can be modeled based on a speed (revolutions per minute) of the engine 30, if desired.

The various components noted above (or others) may be utilized to control movement of the load bin 12 via control of the movement of the one or more hydraulic cylinders 22. Accordingly, these components may be viewed as forming part of the idle state determination system for the ADT 10. Each of the sensors 31*a*, 50, 52, 54, 56 and 58 may be in communication with the controller 44 via a suitable communication architecture.

The ADT 10 can also include a clock, which provides a time of day and a date in order to inform the idle state determination system and method described herein. It should be noted that the time of day and the date may also be received from a global positioning system (GPS; not shown) associated with the ADT 10.

The ADT 10 includes a vehicle communication component 60. The vehicle communication component 60 enables communication between the controller 44 and a remote processing system 62. The vehicle communication component 60 comprises any suitable system for receiving data from and transmitting data to the remote processing system 62. For example, the vehicle communication component 60 may include a radio configured to receive data transmitted by modulating a radio frequency (RF) signal from a remote station (not shown) as is well known to those skilled in the art. For example, the remote station (not shown) may be part of a cellular telephone network and the data may be transmitted according to the long-term evolution (LTE) standard. The vehicle communication component 60 also transmits data to the remote station (not shown) to achieve bi-directional communications. However, other techniques for transmitting and receiving data may alternately be utilized. In one example, the vehicle communication component 60 achieves bi-directional communications with the remote processing system 62 over Bluetooth®, satellite or by utilizing a Wi-Fi standard, i.e., one or more of the 802.11 standards as defined by the Institute of Electrical and Electronics Engineers ("IEEE"), as is well known to those skilled in the art. Thus, the vehicle communication component 60 comprises a Bluetooth® transceiver, a satellite transceiver, a radio transceiver, a cellular transceiver, an LTE transceiver and/or a Wi-Fi transceiver.

In certain embodiments, the vehicle communication component 60 may be configured to encode data or generate encoded data. The encoded data generated by the vehicle communication component 60 may be encrypted. A security key may be utilized to decrypt and decode the encoded data, as is appreciated by those skilled in the art. The security key may be a "password" or other arrangement of data that permits the encoded data to be decrypted. Alternatively, the remote station (not shown) may implement security protocols to ensure that communication takes place between the appropriate ADT 10 and the remote processing system 62.

The remote processing system 62 is in communication with the ADT 10 to receive one or more idle state determinations, as will be discussed herein. In one example, the remote processing system 62 comprises a telematics system. The remote processing system 62 includes a remote communication component 64 and a remote control module 66. The remote control module 66 can be a remote server, or other remote computing device. The remote communication component 64 comprises any suitable system for receiving data from and transmitting data to the vehicle communication component 60. For example, the remote communication component 64 may include a radio configured to receive data transmitted by modulating a radio frequency (RF) signal from a remote station (not shown) as is well known to those skilled in the art. For example, the remote station (not shown) may be part of a cellular telephone network and the data may be transmitted according to the long-term evolution (LTE) standard. The remote communication component 64 also transmits data to the remote station (not shown) to achieve bi-directional communications. However, other techniques for transmitting and receiving data may alternately be utilized. For example, the remote communication component 64 may achieve bi-directional communications with the vehicle communication component 60 over Bluetooth®, satellite, or by utilizing a Wi-Fi standard, i.e., one or more of the 802.11 standards as defined by the Institute of Electrical and Electronics Engineers ("IEEE"), as is known to those skilled in the art. Thus, the remote communication component 64 comprises a Bluetooth® transceiver, a radio transceiver, a cellular transceiver, a satellite transceiver, an LTE transceiver and/or a Wi-Fi transceiver.

The remote communication component 64 may also be configured to encode data or generate encoded data. The encoded data generated by the remote communication component 64 may be encrypted. A security key may be utilized to decrypt and decode the encoded data, as is appreciated by those skilled in the art. The security key may be a "password" or other arrangement of data that permits the encoded data to be decrypted.

The remote control module 66 is in communication with the remote communication component 64 over a suitable interconnection architecture or arrangement that facilitates transfer of data, commands, power, etc. The remote control module 66 may also be in communication with one or more remote users via a remote terminal system 68. The remote control module 66 enables two way data transfer with the ADT 10 via the remote communication component 64, and in certain instances, also enables two-way data transfer with the remote terminal system 68.

The remote terminal system 68 is in communication with the remote processing system 62 to receive data regarding the idle state determinations from the remote processing system 62. In certain examples, the remote terminal system 68 includes a terminal communication component 70, a terminal user interface 72 and a terminal control module 74. The terminal communication component 70 comprises any suitable system for receiving data from and transmitting data to the remote processing system 62. For example, the terminal communication component 70 may include a radio configured to receive data transmitted by modulating a radio frequency (RF) signal from a remote station (not shown) as is well known to those skilled in the art. For example, the remote station (not shown) may be part of a cellular telephone network and the data may be transmitted according to the long-term evolution (LTE) standard. The terminal communication component 70 also transmits data to the remote station (not shown) to achieve bi-directional communications. However, other techniques for transmitting and receiving data may alternately be utilized. For example, the terminal communication component 70 may achieve bi-directional communications with the remote communication component 64 over Bluetooth® or by utilizing a Wi-Fi standard, i.e., one or more of the 802.11 standards as defined by the Institute of Electrical and Electronics Engineers ("IEEE"), as is well known to those skilled in the art. Thus, the terminal communication component 70 comprises a Bluetooth® transceiver, a radio transceiver, a cellular transceiver, an LTE transceiver and/or a Wi-Fi transceiver. In certain examples, the remote terminal system 68 comprises a personal computing device, such as a computer, tablet, cellular smart phone, and so on, which is in communication with the remote processing system 62 over a wired or wireless Internet connection, via a web-based portal, for example.

The terminal communication component 70 may also be configured to encode data or generate encoded data. The encoded data generated by the terminal communication component 70 may be encrypted. A security key may be utilized to decrypt and decode the encoded data, as is appreciated by those skilled in the art. The security key may be a "password" or other arrangement of data that permits the encoded data to be decrypted.

The terminal user interface 72 allows the user of the remote terminal system 68 to interface with the remote processing system 62 (e.g. to input commands and data, and to receive data). In one example, the terminal user interface 72 includes a terminal input device and a terminal display (not separately shown). The terminal input device is any suitable device capable of receiving user input, including, but not limited to, a keyboard, a microphone, a touchscreen layer associated with the terminal display, or other suitable device to receive data and/or commands from the user. Of course, multiple input devices can also be utilized. The terminal display comprises any suitable technology for displaying information, including, but not limited to, a liquid crystal display (LCD), organic light emitting diode (OLED), plasma, or a cathode ray tube (CRT).

The terminal control module 74 is in communication with the terminal communication component 70 and the terminal user interface 72 over a suitable interconnection architecture or arrangement that facilitates transfer of data, commands, power, etc. The terminal control module 74 can be configured as a computing device with associated processor devices and memory architectures, as a hard-wired computing circuit (or circuits), as a programmable circuit, or otherwise. The terminal control module 74 receives input from the terminal user interface 72 and receives data from the remote processing system 62 via the terminal communication component 70. The terminal control module 74 can set the received data from the remote processing system 62 as output for display on the terminal display of the terminal user interface 72. For example, the terminal control module 74 can receive one or more graphical user interfaces for display on the terminal user interface 72 that illustrates the one or more determined idle states of the ADT 10 and the duration for each of the determined idle states. The terminal control module 74 can also transmit data to the remote processing system 62, via the terminal communication component 70. Thus, the terminal control module 74 enables two-way data transfer with the remote processing system 62. In various embodiments, the remote control module 66 of the remote processing system 62 outputs one or more user interfaces for display on the terminal user interface 72 based on the idle state determination system and methods of the present disclosure.

In various embodiments, the controller 44 includes an idle state determination control module 80, which is embedded within the controller 44. The idle state determination control module 80 determines one or more vehicle states based on one or more of the sensor signals received from the sensors 50, 52, 54, 56 and 58; input received from the human-machine interface 46; input received from the clock and further based on the idle state determination system and method of the present disclosure. The idle state determination control module 80 determines one or more idle states and a duration of the respective idle state based on one or more of the sensor signals received from the sensors 31*a*, 50, 52, 54, 56 and 58, an activation signal received from the park brake, input from the clock and further based on the idle state determination system and method of the present disclosure. The idle state determination control module 80 outputs fuel consumption data, idle state data and optionally vehicle state data to the remote processing system 62 based on one or more of the sensor signals received from the sensors 31*a*, 50, 52, 54, 56 and 58; human-machine interface 46; an activation signal received from the park brake; input from the clock and further based on the idle state determination system and method of the present disclosure.

Figure 2:
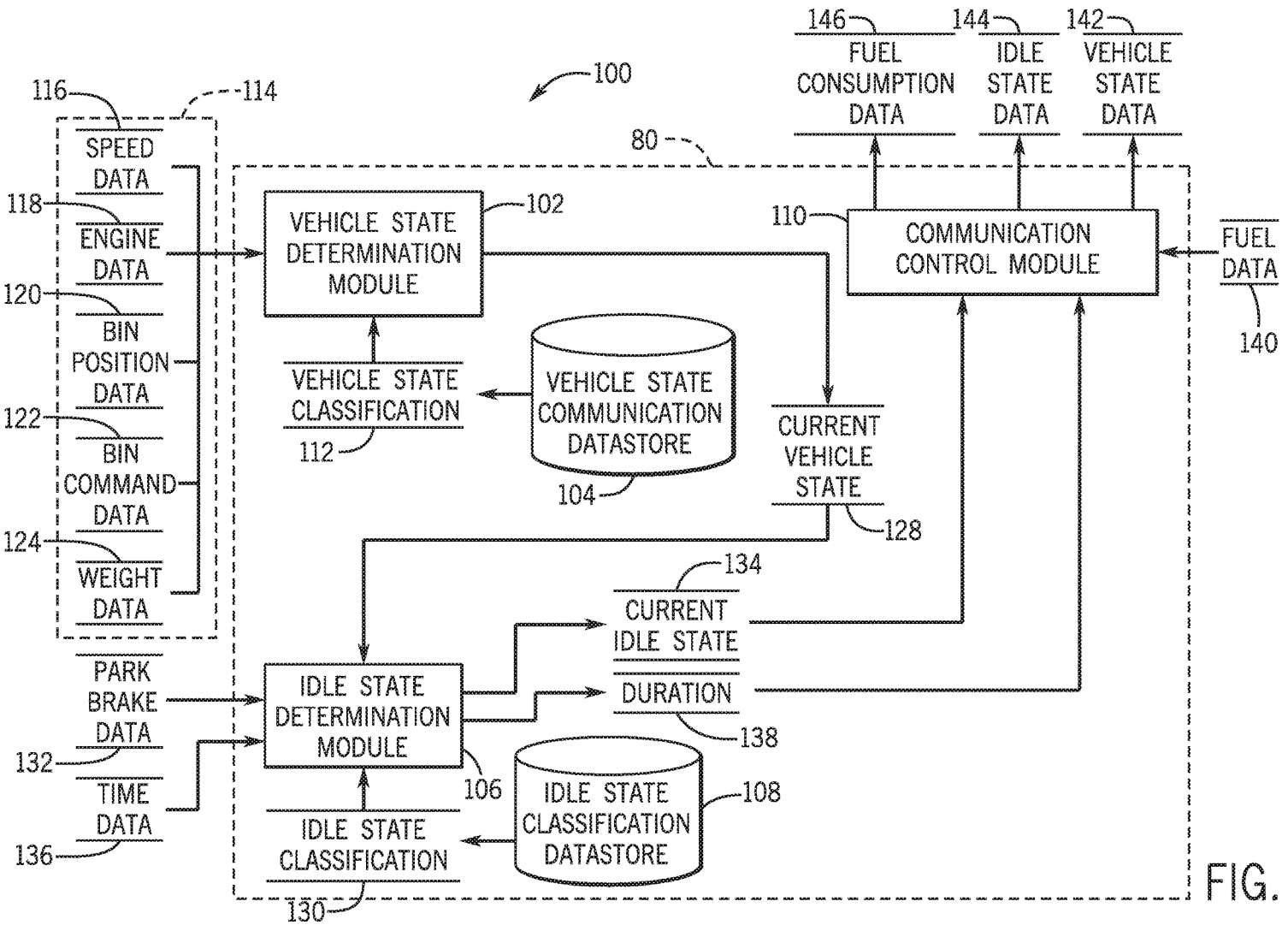
FIG. 2 is a dataflow diagram illustrating an example idle state determination system in accordance with various embodiments.

Referring now also to FIG. 2, a dataflow diagram illustrates various embodiments of an idle state determination system 100 for the ADT 10, which may be embedded within the idle state determination control module 80 of the controller 44. Various embodiments of the idle state determination system 100 according to the present disclosure can include any number of sub-modules embedded within the idle state determination control module 80 of the controller 44. As can be appreciated, the sub-modules shown in FIG. 2 can be combined and/or further partitioned to similarly determine the idle states of the ADT 10. Inputs to the idle state determination system 100 may be received from the sensors 31*a*, 50, 52, 54, 56 and 58 (FIG. 1), the human-machine interface 46 (FIG. 1), received from other control modules (not shown) associated with the ADT 10, and/or determined/modeled by other sub-modules (not shown) within the controller 44. In various embodiments, the idle state determination control module 80 includes a vehicle state determination module 102, a vehicle state classification datastore 104, an idle state determination module 106, an idle state classification datastore 108 and a communication control module 110.

The vehicle state classification datastore 104 stores one or more tables (e.g., lookup tables) that indicate a state of the ADT 10 based on one or more operational parameters. In other words, the vehicle state classification datastore 104 stores one or more tables that provide a vehicle state classification 112 for the ADT 10 based on the one or more operational parameters. In various embodiments, the tables may be interpolation tables that are defined by one or more indexes. As an example, one or more tables can be indexed by various operational parameters such as, but not limited to, vehicle speed, engine state, bin position, bin command, payload weight and park brake state, to provide the vehicle state classification 112. In one example, the vehicle state classification datastore 104 stores an engine off vehicle state, a stationary laden vehicle state, a stationary semi-laden vehicle state, a stationary unladen vehicle state, a stationary dumping vehicle state, a transport laden vehicle state, a transport semi-laden vehicle state, a transport unladed vehicle state, a transport dumping vehicle state and an invalid input vehicle state.

The vehicle state determination module 102 receives as input work vehicle data or operational parameter data 114. In one example, the operational parameter data 114 comprises speed data 116, engine data 118, bin position data 120, bin command data 122 and weight data 124. The speed data 116 comprises a speed of the ADT 10 as received as sensor data or sensor signals from the sensors 58. The engine data 118 comprises a state of the engine 30, for example, a running state or an off state, which is received from the engine control module 30*a*. The bin position data 120 comprises a position of the load bin 12, as received as sensor data or sensor signals from the sensors 54 and/or sensors 56. The bin command data 122 comprises an input received via the human-machine interface 46, which includes a command to initiate a movement of the load bin 12. In certain embodiments, the bin command data 122 includes an amount of current to be supplied to the pumps 40 to drive the hydraulic cylinders 22 to move the load bin 12 between the lowered position L and the raised position R. The weight data 124 comprises a weight of the payload in the load bin 12, which is received as sensor data or sensor signals from the sensors 52.

The vehicle state determination module 102 processes the operational parameter data 114 and based on the operational parameter data 114, queries the vehicle state classification datastore 104 to determine the vehicle state classification 112. The vehicle state determination module 102 classifies a current vehicle state based on the retrieved vehicle state classification 112, and sets the current vehicle state 128 for the idle state determination module 106 and the communication control module 110.

In one example, based on the engine data 118 as the engine off vehicle state, the vehicle state determination module 102 retrieves the vehicle state classification 112 from the vehicle state classification datastore 104 and classifies the current vehicle state 128 as an engine off vehicle state. Based on the previous vehicle state classified as engine off, and the engine data 118 as engine running, the vehicle state determination module 102 retrieves the vehicle state classification 112 from the vehicle state classification datastore 104 and classifies the current vehicle state 128 as a stationary unladen vehicle state.

Based on the previous vehicle state not being classified as the engine off vehicle state, the vehicle state determination module 102 retrieves the vehicle state classification 112 from the vehicle state classification datastore 104 based on the speed data 116, the bin position data 120, the bin command data 122 and the weight data 124. Generally, the vehicle state determination module 102 classifies or classifies the current state of the ADT 10 throughout a period of operation of the ADT 10. In one example, the period of operation can comprise a single off/on cycle of the engine 30. The vehicle state determination module 102 can store the previous vehicle state and the classified current vehicle state 128 in a memory associated with the vehicle state determination module 102, or in a datastore in communication with the vehicle state determination module 102.

In one example, based on the current vehicle state 128 classified as the stationary unladen vehicle state and based on the bin position data 120 or the bin command data 122, the vehicle state determination module 102 retrieves the vehicle state classification 112 from the vehicle state classification datastore 104 and classifies the current vehicle state 128 as a stationary dumping vehicle state. The stationary dumping vehicle state is classified based on the bin position data 120 indicating an incline of the load bin 12 as greater than a position threshold, for example, about 5%, for at least one second, or based on the receipt of a command to initiate a movement of the load bin 12 between the lowered position L and the raised position R while the ADT 10 is currently classified in a stationary state.

In one example, based on the current vehicle state 128 classified as the stationary unladen vehicle state and based on the speed data 116, the vehicle state determination module 102 retrieves the vehicle state classification 112 from the vehicle state classification datastore 104 and classifies the current vehicle state 128 as a transport unladen vehicle state. The transport unladen vehicle state is classified based on the speed data 116 indicating the speed of the ADT 10 as greater than a speed threshold, for example, about 5 kilometers per hour (kph), for at least one second.

Based on the current vehicle state 128 classified as the stationary unladen vehicle state and based on the weight data 124, the vehicle state determination module 102 retrieves the vehicle state classification 112 from the vehicle state classification datastore 104 and classifies the current vehicle state 128 as a stationary semi-laden vehicle state. The stationary semi-laden vehicle state is classified based on the weight data 124 indicating the weight of the payload in the load bin 12 is greater than a first weight threshold, but less than a second weight threshold, for at least two seconds. In one example, the first weight threshold is about 30% of a rated payload capacity or a maximum weight that is receivable by the load bin 12 and the second weight threshold is about 90% of the rated payload capacity or the maximum weight that is receivable by the load bin 12.

Based on the current vehicle state 128 classified as the stationary unladen vehicle state and based on the weight data 124, the vehicle state determination module 102 retrieves the vehicle state classification 112 from the vehicle state classification datastore 104 and classifies the current vehicle state 128 as a stationary laden vehicle state. The stationary laden vehicle state is classified based on the weight data 124 indicating the weight of the payload in the load bin 12 as greater than the second weight threshold for at least two seconds.

In one example, based on the current vehicle state 128 classified as the stationary laden vehicle state and based on the bin position data 120 or the bin command data 122, the vehicle state determination module 102 retrieves the vehicle state classification 112 from the vehicle state classification datastore 104 and classifies the current vehicle state 128 as the stationary dumping vehicle state.

Based on the current vehicle state 128 classified as the stationary laden vehicle state and based on the speed data 116, the vehicle state determination module 102 retrieves the vehicle state classification 112 from the vehicle state classification datastore 104 and classifies the current vehicle state 128 as a transport laden vehicle state. The transport laden vehicle state is classified based on the speed data 116 indicating the speed of the ADT 10 as greater than the speed threshold for at least one second.

Based on the current vehicle state 128 classified as the stationary laden vehicle state and based on the weight data 124, the vehicle state determination module 102 retrieves the vehicle state classification 112 from the vehicle state classification datastore 104 and classifies the current vehicle state 128 as the stationary semi-laden vehicle state. Based on the current vehicle state 128 classified as the stationary laden vehicle state and based on the weight data 124, the vehicle state determination module 102 retrieves the vehicle state classification 112 from the vehicle state classification datastore 104 and classifies the current vehicle state 128 as the stationary unladen vehicle state. In this example, the stationary unladen vehicle state is classified based on the weight data 124 indicating that the weight of the payload is less than the first weight threshold for at least two seconds.

In one example, based on the current vehicle state 128 classified as the stationary semi-laden vehicle state and based on the bin position data 120 or the bin command data 122, the vehicle state determination module 102 retrieves the vehicle state classification 112 from the vehicle state classification datastore 104 and classifies the current vehicle state 128 as the stationary dumping vehicle state. Based on the current vehicle state 128 classified as the stationary semi-laden vehicle state and based on the speed data 116, the vehicle state determination module 102 retrieves the vehicle state classification 112 from the vehicle state classification datastore 104 and classifies the current vehicle state 128 as the transport semi-laden vehicle state. The transport semi-laden vehicle state is classified based on the speed data 116 indicating the speed of the ADT 10 as greater than the speed threshold for at least one second.

Based on the current vehicle state 128 classified as the stationary semi-laden vehicle state and based on the weight data 124, the vehicle state determination module 102 retrieves the vehicle state classification 112 from the vehicle state classification datastore 104 and classifies the current vehicle state 128 as the stationary laden vehicle state. Based on the current vehicle state 128 classified as the stationary semi-laden vehicle state and based on the weight data 124, the vehicle state determination module 102 retrieves the vehicle state classification 112 from the vehicle state classification datastore 104 and classifies the current vehicle state 128 as the stationary unladen vehicle state.

Based on the current vehicle state 128 classified as the transport unladen vehicle state and based on the bin position data 120 or the bin command data 122, the vehicle state determination module 102 retrieves the vehicle state classification 112 from the vehicle state classification datastore 104 and classifies the current vehicle state 128 as the transport dumping vehicle state. The transport dumping vehicle state is classified based on the bin position data 120 indicating an incline of the load bin 12 as greater than the position threshold for at least one second, or based on the receipt of a command to initiate a movement of the load bin 12 between the lowered position L and the raised position R while the ADT 10 is currently classified in a transport state.

Based on the current vehicle state 128 classified as the transport unladen vehicle state and based on the speed data 116, the vehicle state determination module 102 retrieves the vehicle state classification 112 from the vehicle state classification datastore 104 and classifies the current vehicle state 128 as the stationary unladen vehicle state. The stationary unladen vehicle state is classified based on the speed data 116 indicating the speed of the ADT 10 is less than the speed threshold for at least one second.

In one example, based on the current vehicle state 128 classified as the transport unladen vehicle state and based on the weight data 124, the vehicle state determination module 102 retrieves the vehicle state classification 112 from the vehicle state classification datastore 104 and classifies the current vehicle state 128 as the transport semi-laden vehicle state. The transport semi-unladen vehicle state is classified based on the weight data 124 indicating that the weight of the payload in the load bin 12 is greater than the first weight threshold, but less than the second weight threshold, for at least two seconds. Based on the current vehicle state 128 classified as the transport unladen vehicle state and based on the weight data 124, the vehicle state determination module 102 retrieves the vehicle state classification 112 from the vehicle state classification datastore 104 and classifies the current vehicle state 128 as the transport laden vehicle state. The transport unladen vehicle state is classified based on the weight data 124 indicating the weight of the payload in the load bin 12 is greater than the second weight threshold for at least two seconds.

Based on the current vehicle state 128 classified as the transport laden vehicle state and based on the bin position data 120 or the bin command data 122, the vehicle state determination module 102 retrieves the vehicle state classification 112 from the vehicle state classification datastore 104 and classifies the current vehicle state 128 as the transport dumping vehicle state. Based on the current vehicle state 128 classified as the transport laden vehicle state and based on the speed data 116, the vehicle state determination module 102 retrieves the vehicle state classification 112 from the vehicle state classification datastore 104 and classifies the current vehicle state 128 as the stationary laden vehicle state. The stationary laden vehicle state is classified based on the speed data 116 indicating the speed of the ADT 10 is less than the speed threshold for at least one second.

In one example, based on the current vehicle state 128 classified as the transport laden vehicle state and based on the weight data 124, the vehicle state determination module 102 retrieves the vehicle state classification 112 from the vehicle state classification datastore 104 and classifies the current vehicle state 128 as the transport semi-laden vehicle state. The transport semi-unladen vehicle state is classified based on the weight data 124 indicating that the weight of the payload in the load bin 12 is greater than the first weight threshold, but less than the second weight threshold, for at least two seconds. Based on the current vehicle state 128 classified as the transport laden vehicle state and based on the weight data 124, the vehicle state determination module 102 retrieves the vehicle state classification 112 from the vehicle state classification datastore 104 and classifies the current vehicle state 128 as the transport unladen vehicle state. The transport unladen vehicle state is classified based on the weight data 124 indicating the weight of the payload in the load bin 12 is less than the first weight threshold for at least two seconds.

Based on the current vehicle state 128 classified as the transport semi-laden vehicle state and based on the bin position data 120 or the bin command data 122, the vehicle state determination module 102 retrieves the vehicle state classification 112 from the vehicle state classification datastore 104 and classifies the current vehicle state 128 as the transport dumping vehicle state. Based on the current vehicle state 128 classified as the transport semi-laden vehicle state and based on the speed data 116, the vehicle state determination module 102 retrieves the vehicle state classification 112 from the vehicle state classification datastore 104 and classifies the current vehicle state 128 as the stationary semi-laden vehicle state. The stationary laden vehicle state is classified based on the speed data 116 indicating the speed of the ADT 10 is less than the speed threshold for at least one second.

Based on the current vehicle state 128 classified as the transport semi-laden vehicle state and based on the weight data 124, the vehicle state determination module 102 retrieves the vehicle state classification 112 from the vehicle state classification datastore 104 and classifies the current vehicle state 128 as the transport laden vehicle state. The transport laden vehicle state is classified based on the weight data 124 indicating that the weight of the payload in the load bin 12 is greater than the second weight threshold for at least two seconds. Based on the current vehicle state 128 classified as the transport laden vehicle state and based on the weight data 124, the vehicle state determination module 102 retrieves the vehicle state classification 112 from the vehicle state classification datastore 104 and classifies the current vehicle state 128 as the transport unladen vehicle state.

Based on the current vehicle state 128 classified as the stationary dumping vehicle state, based on the bin position data 120 or the bin command data 122, and the weight data 124, the vehicle state determination module 102 retrieves the vehicle state classification 112 from the vehicle state classification datastore 104 and classifies the current vehicle state 128 as the stationary unladen vehicle state. The stationary unladen vehicle state is classified based on the bin position data 120 indicating an incline of the load bin 12 as less than the position threshold for at least one second or based on the receipt of the command to initiate a movement of the load bin 12 between the raised position R and the lowered position L, and based on the weight data 124 indicating that the weight of the payload in the load bin 12 is less than the first weight threshold.

Based on the current vehicle state 128 classified as the stationary dumping vehicle state, based on the bin position data 120 or the bin command data 122, and the weight data 124, the vehicle state determination module 102 retrieves the vehicle state classification 112 from the vehicle state classification datastore 104 and classifies the current vehicle state 128 as the stationary semi-laden vehicle state. The stationary semi-laden vehicle state is classified based on the bin position data 120 indicating an incline of the load bin 12 as less than the position threshold for at least one second or based on the receipt of the input command to initiate a movement of the load bin 12 between the raised position R and the lowered position L, and based on the weight data 124 indicating that the weight of the payload in the load bin 12 is greater than the first weight threshold, but less than the second weight threshold.

Based on the current vehicle state 128 classified as the stationary dumping vehicle state, based on the bin position data 120 or the bin command data 122, and the weight data 124, the vehicle state determination module 102 retrieves the vehicle state classification 112 from the vehicle state classification datastore 104 and classifies the current vehicle state 128 as the stationary laden vehicle state. The stationary laden vehicle state is classified based on the bin position data 120 indicating an incline of the load bin 12 as less than the position threshold for at least one second or based on the receipt of the command to initiate a movement of the load bin 12 between the raised position R and the lowered position L, and based on the weight data 124 indicating that the weight of the payload in the load bin 12 is less than the first weight threshold.

Based on the current vehicle state 128 classified as the stationary dumping vehicle state and based on the speed data 116, the vehicle state determination module 102 retrieves the vehicle state classification 112 from the vehicle state classification datastore 104 and classifies the current vehicle state 128 as the transport dumping vehicle state.

In one example, based on the current vehicle state 128 classified as the transport dumping vehicle state, based on the bin position data 120 or the bin command data 122, and the weight data 124, the vehicle state determination module 102 retrieves the vehicle state classification 112 from the vehicle state classification datastore 104 and classifies the current vehicle state 128 as the transport unladen vehicle state. The transport unladen vehicle state is classified based on the bin position data 120 indicating an incline of the load bin 12 as less than the position threshold for at least one second or based on the receipt of the command to initiate a movement of the load bin 12 between the raised position R and the lowered position L, and based on the weight data 124 indicating that the weight of the payload in the load bin 12 is less than the first weight threshold.

Based on the current vehicle state 128 classified as the transport dumping vehicle state, based on the bin position data 120 or the bin command data 122, and the weight data 124, the vehicle state determination module 102 retrieves the vehicle state classification 112 from the vehicle state classification datastore 104 and classifies the current vehicle state 128 as the transport semi-laden vehicle state. The transport semi-laden vehicle state is classified based on the bin position data 120 indicating an incline of the load bin 12 as less than the position threshold for at least one second or based on the receipt of the input command to initiate a movement of the load bin 12 between the raised position R and the lowered position L, and based on the weight data 124 indicating that the weight of the payload in the load bin 12 is greater than the first weight threshold, but less than the second weight threshold.

Based on the current vehicle state 128 classified as the transport dumping vehicle state, based on the bin position data 120 or the bin command data 122, and the weight data 124, the vehicle state determination module 102 retrieves the vehicle state classification 112 from the vehicle state classification datastore 104 and classifies the current vehicle state 128 as the transport laden vehicle state. The transport laden vehicle state is classified based on the bin position data 120 indicating an incline of the load bin 12 as less than the position threshold for at least one second or based on the receipt of the command to initiate a movement of the load bin 12 between the raised position R and the lowered position L, and based on the weight data 124 indicating that the weight of the payload in the load bin 12 is less than the first weight threshold.

Based on the current vehicle state 128 classified as the transport dumping vehicle state and based on the speed data 116, the vehicle state determination module 102 retrieves the vehicle state classification 112 from the vehicle state classification datastore 104 and classifies the current vehicle state 128 as the stationary dumping vehicle state. The stationary dumping vehicle state is classified based on the speed data 116 indicating the speed of the ADT 10 is less than the speed threshold for at least one second.

The vehicle state determination module 102 also determines whether the engine data 118 indicates a change in the state of the engine from the running state to the off state. Based on the change in the engine data 118 from the running state to the off state, the vehicle state determination module 102 classifies the current vehicle state 128 to the engine off vehicle state.

The vehicle state determination module 102 also determines whether one or more of the operational parameter data 114 exceeds an acceptable value. For example, the vehicle state determination module 102 determines whether the speed data 116, the bin position data 120, the bin command data 122 and/or the weight data 124 exceeds a respective maximum value for each of the speed data 116, the bin position data 120, the bin command data 122 and/or the weight data 124. If one or more of the operational parameter data 114 exceeds the respective acceptable value, the vehicle state determination module 102 classifies the current vehicle state 128 to an invalid input vehicle state.

The idle state classification datastore 108 stores one or more tables (e.g., lookup tables) that indicate an idle state classification of the ADT 10 based on one or more current vehicle states 128 of the ADT 10. In other words, the idle state classification datastore 108 stores one or more tables that provide an idle state classification 130 for the ADT 10 based on the previous vehicle state and/or the current vehicle state. In various embodiments, the tables may be interpolation tables that are defined by one or more indexes. As an example, one or more tables can be indexed by various parameters such as, but not limited to, current vehicle state, previous vehicle state, etc., to provide the idle state classification 130. In one example, the idle state classification datastore 108 stores a warm-up idle state classification, a waiting to load idle state classification, a loading idle state classification, a wait during haul idle state classification, a waiting to dump idle state classification, a wait during return idle state classification, a break time idle state classification and a cool down idle state classification.

The idle state determination module 106 receives as input the current vehicle state 128 and park brake data 132. The park brake data 132 comprises a status of the park brake 28, for example, activated or inactivated, which is received from as a signal from the park brake 28, or is received from other modules associated with the ADT 10. The idle state determination module 106 stores a previous vehicle state (i.e. a prior current vehicle state 128), the current vehicle state 128 and determines a transition to a new current vehicle state 128 based on the receipt of the current vehicle state 128 from the vehicle state determination module 102, which is different than the current vehicle state 128. Based on the previous vehicle state, the current vehicle state 128 and the park brake data 132, the idle state determination module 106 determines an idle state and retrieves the idle state classification 130 from the idle state classification datastore 108. Based on the retrieved idle state classification, the idle state determination module 106 classifies the idle state, and sets a current idle state 134 for the communication control module 110. It should be noted that since each current vehicle state 128 is determined based on one or more of the operational parameter data 114, each of the determined idle states are classified based on one or more of the operational parameter data 114.

The idle state determination module 106 receives as input time data 136, from the clock associated with the ADT 10. Based on the determination of a start of an idle state, the idle state determination module 106 determines a start time that corresponds with the start of the idle state. Based on the determination of an end of an idle state, the idle state determination module 106 determines an end time of the idle state based on the time data 136 and computes a duration 138 of the current idle state 134. The idle state determination module 106 sets the duration 138 of the current idle state 134 for the communication control module 110.

In various embodiments, the idle state determination module 106 determines a start of an idle state based on a transition from a previous vehicle state (e.g. the prior current vehicle state 128) and determines an end of an idle state based on a transition from the current vehicle state 128 to a different current vehicle state 128.

For example, based on a previous vehicle state of the engine off vehicle state and a transition to the current vehicle state 128 of the stationary unladen vehicle state, the stationary semi-laden vehicle state or the stationary laden vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the warm-up idle state. The idle state determination module 106 determines an end of the determined idle state (i.e. warm-up idle state) based on a transition from the current vehicle state 128 of stationary unladen vehicle state, the stationary semi-laden vehicle state or the stationary laden vehicle state to the current vehicle state 128 of the transport unladen vehicle state, the transport semi-laden vehicle state or the transport laden vehicle state. Based on the determination of the end of the determined idle state (i.e. warm-up idle state), the idle state determination module 106 determines the end time for the warm-up idle state based on the time data 136, and sets the current idle state 134 and the duration 138 of the current idle state 134 for the communication control module 110.

Based on a previous vehicle state of the transport unladen vehicle state for less than a time threshold (determined based on the time data 136), such as about 30 seconds, and a transition to the current vehicle state 128 of the stationary unladen vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the waiting to load idle state. The idle state determination module 106 determines an end of the determined idle state (i.e. waiting to load idle state) based on a transition from the current vehicle state 128 of stationary unladen vehicle state to the current vehicle state 128 of the stationary semi-laden vehicle state. Based on the determination of the end of the determined idle state (i.e. waiting to load idle state), the idle state determination module 106 determines the end time for the waiting to load idle state based on the time data 136, and sets the current idle state 134 and the duration 138 of the current idle state 134 for the communication control module 110.

Based on a previous vehicle state of the stationary unladen vehicle state and a transition to the current vehicle state 128 of the stationary semi-laden vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the loading idle state. The idle state determination module 106 determines an end of the determined idle state (i.e. loading idle state) based on a transition from the current vehicle state 128 of stationary semi-laden vehicle state to the current vehicle state 128 of the transport semi-laden vehicle state or the transport laden state. Based on the determination of the end of the determined idle state (i.e. loading idle state), the idle state determination module 106 determines the end time for the loading idle state based on the time data 136, and sets the current idle state 134 and the duration 138 of the current idle state 134 for the communication control module 110.

Based on a previous vehicle state of the transport semi-laden vehicle state or the transport laden vehicle state for greater than the time threshold (determined based on the time data 136), and a transition to the current vehicle state 128 of the stationary semi-laden vehicle state or the stationary laden vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the wait during haul idle state. The idle state determination module 106 determines an end of the determined idle state (i.e. wait during haul idle state) based on a transition from the current vehicle state 128 of the stationary semi-laden vehicle state or the stationary laden vehicle state to the current vehicle state 128 of the transport semi-laden vehicle state or the transport laden vehicle state. Based on the determination of the end of the determined idle state (i.e. wait during haul idle state), the idle state determination module 106 determines the end time for the wait during haul idle state based on the time data 136, and sets the current idle state 134 and the duration 138 of the current idle state 134 for the communication control module 110.

Based on a previous vehicle state of the transport semi-laden vehicle state or the transport laden vehicle state for less than the time threshold (determined based on the time data 136), and a transition to the current vehicle state 128 of the stationary semi-laden vehicle state or the stationary laden vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the waiting to dump idle state. The idle state determination module 106 determines an end of the determined idle state (i.e. waiting to dump idle state) based on a transition from the current vehicle state 128 of the stationary semi-laden vehicle state or the stationary laden vehicle state to the current vehicle state 128 of the stationary dumping vehicle state or the transport dumping vehicle state. Based on the determination of the end of the determined idle state (i.e. waiting to dump idle state), the idle state determination module 106 determines the end time for the waiting to dump idle state based on the time data 136, and sets the current idle state 134 and the duration 138 of the current idle state 134 for the communication control module 110.

Based on a previous vehicle state of the transport unladen vehicle state for greater than the time threshold (determined based on the time data 136), and a transition to the current vehicle state 128 of the stationary unladen vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the wait during return idle state. The idle state determination module 106 determines an end of the determined idle state (i.e. wait during return idle state) based on a transition from the current vehicle state 128 of the stationary unladen vehicle state to the current vehicle state 128 of the transport unladen vehicle state. Based on the determination of the end of the determined idle state (i.e. wait during return idle state), the idle state determination module 106 determines the end time for the wait during return idle state based on the time data 136, and sets the current idle state 134 and the duration 138 of the current idle state 134 for the communication control module 110.

Based on a previous vehicle state of the stationary unladen vehicle state, the stationary semi-laden vehicle state or the stationary laden vehicle state, a transition to the current vehicle state 128 of the stationary unladen vehicle state, the stationary semi-laden vehicle state or the stationary laden vehicle state for greater than a second time threshold, such as about 5 minutes, (determined based on the time data 136) and the park brake data 132, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the break time idle state. The idle state determination module 106 determines an end of the determined idle state (i.e. break time idle state) based on a transition from the current vehicle state 128 of the stationary unladen vehicle state, the stationary semi-laden vehicle state or the stationary laden vehicle state to the current vehicle state 128 of the transport unladen vehicle state, the transport semi-laden vehicle state or the transport laden vehicle state. Based on the determination of the end of the determined idle state (i.e. break time idle state), the idle state determination module 106 determines the end time for the break time idle state based on the time data 136, and sets the current idle state 134 and the duration 138 of the current idle state 134 for the communication control module 110.

Based on a current vehicle state of the stationary unladen vehicle state, the stationary semi-laden vehicle state or the stationary laden vehicle state, and a transition to the current vehicle state 128 of the engine off vehicle state, the idle state determination module 106 determines a start of an idle state, and determines a start time based on the time data 136. The idle state determination module 106 queries the idle state classification datastore 108 to retrieve the idle state classification 130 associated with the transition from the previous vehicle state to the current vehicle state 128. In this example, the idle state determination module 106 classifies the determined idle state as the cool down idle state. The idle state determination module 106 determines an end of the determined idle state (i.e. cool down idle state) once the engine 30 of the ADT 10 is completely off and shut down. Based on the determination of the end of the determined idle state (i.e. cool down idle state), the idle state determination module 106 determines the end time for the cool down idle state based on the time data 136, and sets the current idle state 134 and the duration 138 of the current idle state 134 for the communication control module 110.

The communication control module 110 receives as input the current vehicle state 128, the current idle state 134 and the duration 138 of the current idle state 134 over a period of operation of the ADT 10. As discussed, the period of operation of the ADT 10 can be measured based on an engine on/engine off cycle, but can also be measured in hours, days, weeks, etc. The communication control module 110 also receives as input fuel data 140. The fuel data 140 comprises sensor data or sensor signals from the level sensors 31*a*, and indicates a level of fuel in the fuel tank 31.

Based on the current vehicle state 128, the communication control module 110 compiles the received current vehicle states 128 and outputs vehicle state data 142 for the remote processing system 62, which comprises the one or more vehicle states determined during the operation of the ADT 10 for the period. Based on the current idle state 134 and the duration 138, the communication control module 110 compiles the current idle state 134 and the duration 138, and outputs idle state data 144 for the remote processing system 62. The idle state data 144 comprises the one or more idle states determined during the operation of the ADT 10 for the period, and includes the duration 138 of each of the determined idle states during the operation of ADT 10 for the period. Stated another way, the idle state data 114 comprises an amount of time spent by the ADT 10 in each of the plurality of idle states based on the duration for each of the plurality of idle states over the period of operation.

Based on the fuel data 140, the communication control module 110 computes fuel consumption data 146, which comprises an amount of fuel consumed during the operation of the ADT 10 for the period. Stated another way, the fuel consumption data 146 comprises the amount of fuel consumed by the ADT 10 in each of the plurality of idle states based on the duration for each of the plurality of idle states over the period of operation of the work vehicle and the fuel data 140 received from the sensors 31*a*. The communication control module 110 outputs the fuel consumption data 146 for the remote processing system 62. It should be noted that the vehicle state data 142, the idle state data 144 and the fuel consumption data 146 need not be complied for during the operation of the ADT 10 for a period, but can be complied and set based on other factors, or can be sent substantially in real-time.

Figure 3:
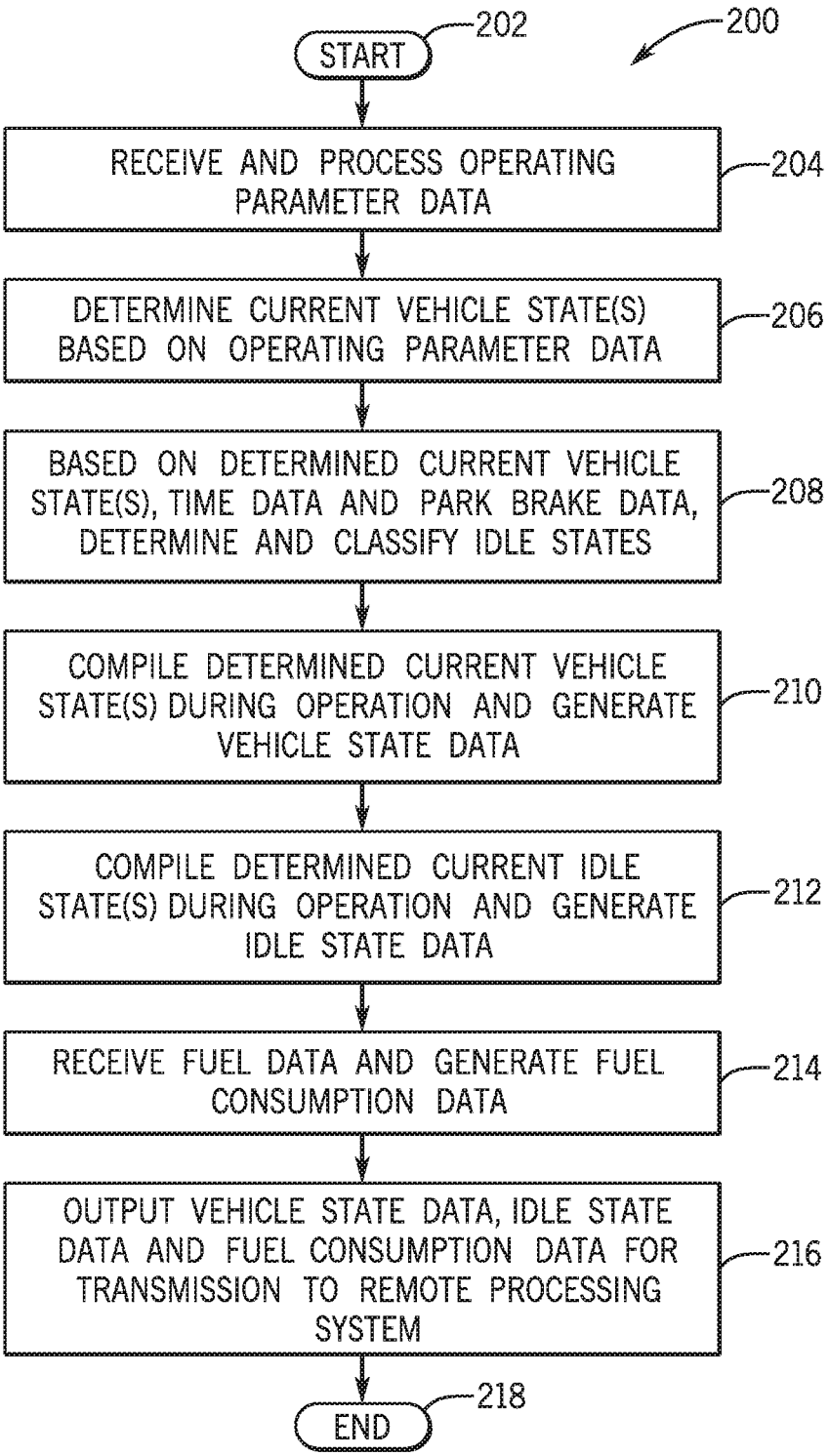
FIG. 3 is a flowchart illustrating an example method of the idle state determination system of FIG. 1 in accordance with various embodiments.

Referring now also to FIG. 3, a flowchart illustrates a method 200 that may be performed by the idle state determination control module 80 of the controller 44 of FIGS. 1 and 2 in accordance with the present disclosure. As can be appreciated in light of the disclosure, the order of operation within the method is not limited to the sequential execution as illustrated in FIG. 3, but may be performed in one or more varying orders as applicable and in accordance with the present disclosure.

In various embodiments, the method may be scheduled to run based on predetermined events, such as based on the engine data 118 indicating the running state of the engine 30 from a previous off state, or periodically.

Figure 4:
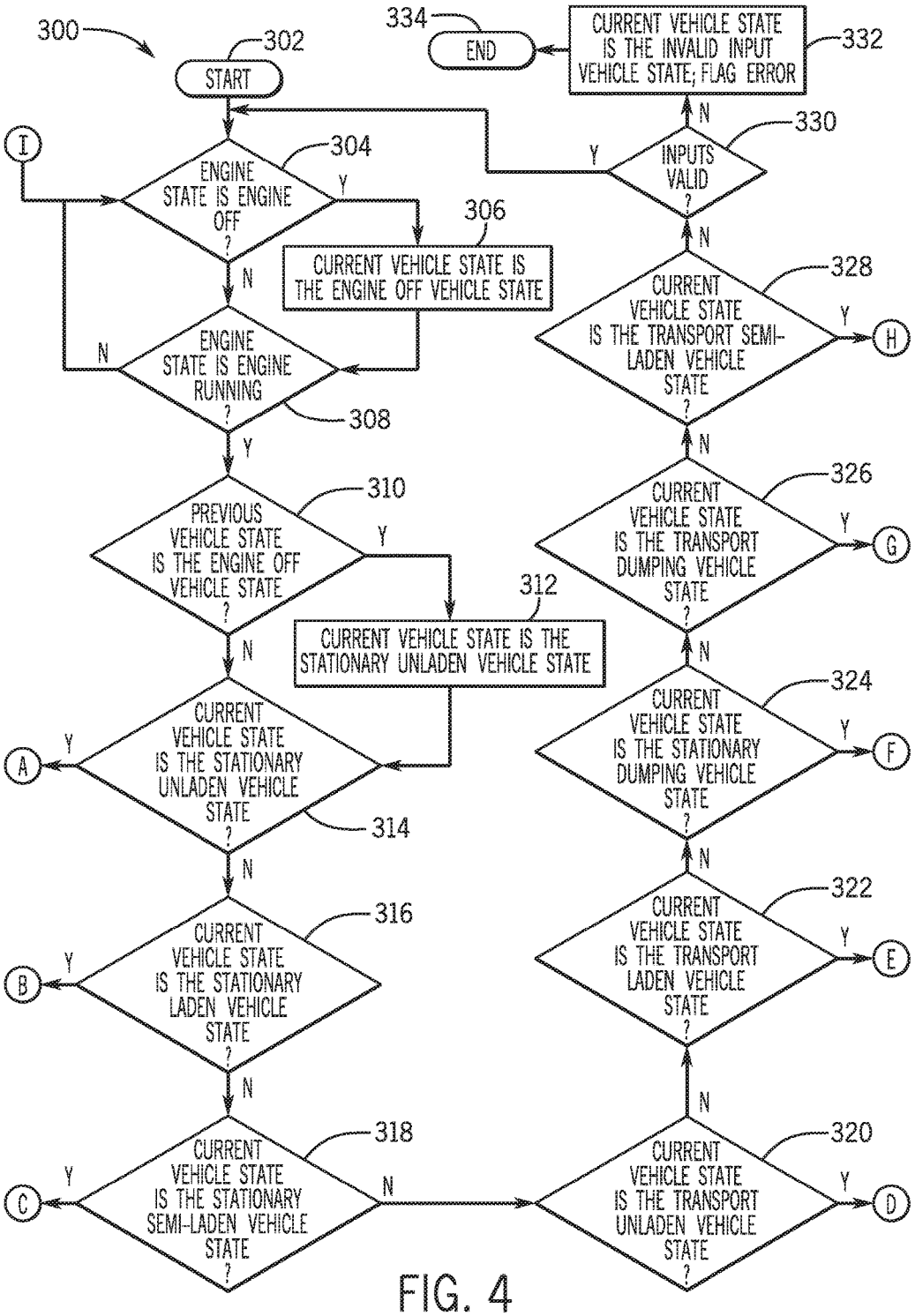
FIG. 4 is a flowchart illustrating an example method for determining a vehicle state in accordance with various embodiments.

In one example, with reference to FIG. 3, the method begins at 202. At 204, the method receives and processes the operational parameter data 114. At 206, the method determines and classifies the one or more vehicle states of the ADT 10 based on the operational parameter data 114. For example, with reference to FIG. 4, a flowchart illustrates a method 300 for determining and classifying the one or more vehicle states that can be performed by the idle state determination control module 80 of the controller 44 of FIGS. 1 and 2 in accordance with the present disclosure. As can be appreciated in light of the disclosure, the order of operation within the method is not limited to the sequential execution as illustrated in FIG. 4, but may be performed in one or more varying orders as applicable and in accordance with the present disclosure.

The method begins at 302. At 304, the method determines whether the engine data 118 indicates that the engine is off. If the engine state is off, at 306, the method retrieves the vehicle state classification 112 from the vehicle state classification datastore 104 and classifies the current vehicle state 128 as the engine off vehicle state.

Otherwise, at 308, the method determines whether the engine data 118 indicates that the state of the engine 30 is running. If the state of the engine 30 is running, the method proceeds to 310. Otherwise, the method loops to 304.

At 310, the method determines whether the previous vehicle state is the engine off vehicle state. If the previous vehicle state is the engine off vehicle state, at 312, the method retrieves the vehicle state classification 112 from the vehicle state classification datastore 104 and classifies the current vehicle state 128 as the stationary unladen vehicle state. Otherwise, at 314, the method determines whether the current vehicle state 128 is the stationary unladen vehicle state. If true, the method proceeds to A on FIG. 5.

If false, at 316, the method determines whether the current vehicle state 128 is the stationary laden vehicle state. If true, the method proceeds to B on FIG. 6. If false, at 318, the method determines whether the current vehicle state 128 is the stationary semi-laden vehicle state. If the current vehicle state 128 is the stationary semi-laden vehicle state, the method proceeds to C on FIG. 7. Otherwise, at 320, the method determines whether the current vehicle state 128 is the transport unladed vehicle state. If the current vehicle state 128 is the transport unladen vehicle state, the method proceeds to D on FIG. 8. Otherwise, at 322, the method determines whether the current vehicle state 128 is the transport laden vehicle state. If true, the method proceeds to E on FIG. 9. If false, at 324, the method determines whether the current vehicle state 128 is the stationary dumping vehicle state.

Figure 10:
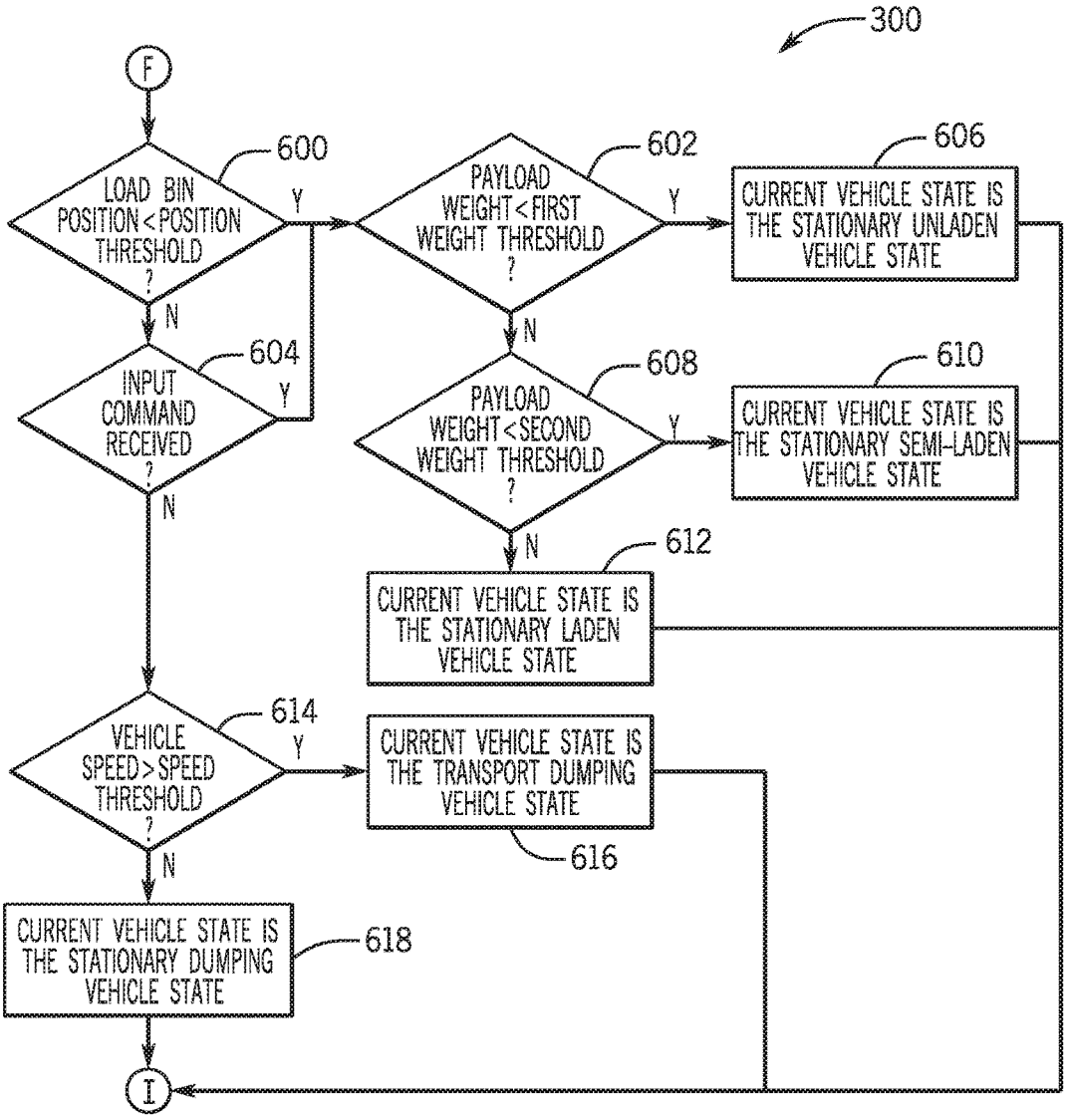
FIG. 10 is a continuation of the flowchart of FIG. 4.

If the current vehicle state 128 is the stationary dumping vehicle state, the method proceeds to F on FIG. 10. Otherwise, at 326, the method determines whether the current vehicle state 128 is the transport dumping vehicle state. If true, the method proceeds to G on FIG. 11. If false, at 328, the method determines whether the current vehicle state 128 is the transport semi-laden vehicle state. If true, the method proceeds to H on FIG. 12. Otherwise, at 330, the method determines whether the inputs are valid, such that the operational parameter data 114 is below a maximum value for each one of the respective operational parameter data 114. If the inputs are invalid, at 332, the method retrieves the vehicle state classification 112 from the vehicle state classification datastore 104 and classifies the current vehicle state 128 as the invalid input vehicle state and flags an error. The method ends at 334. Otherwise, the method loops to 304.

Figure 5:
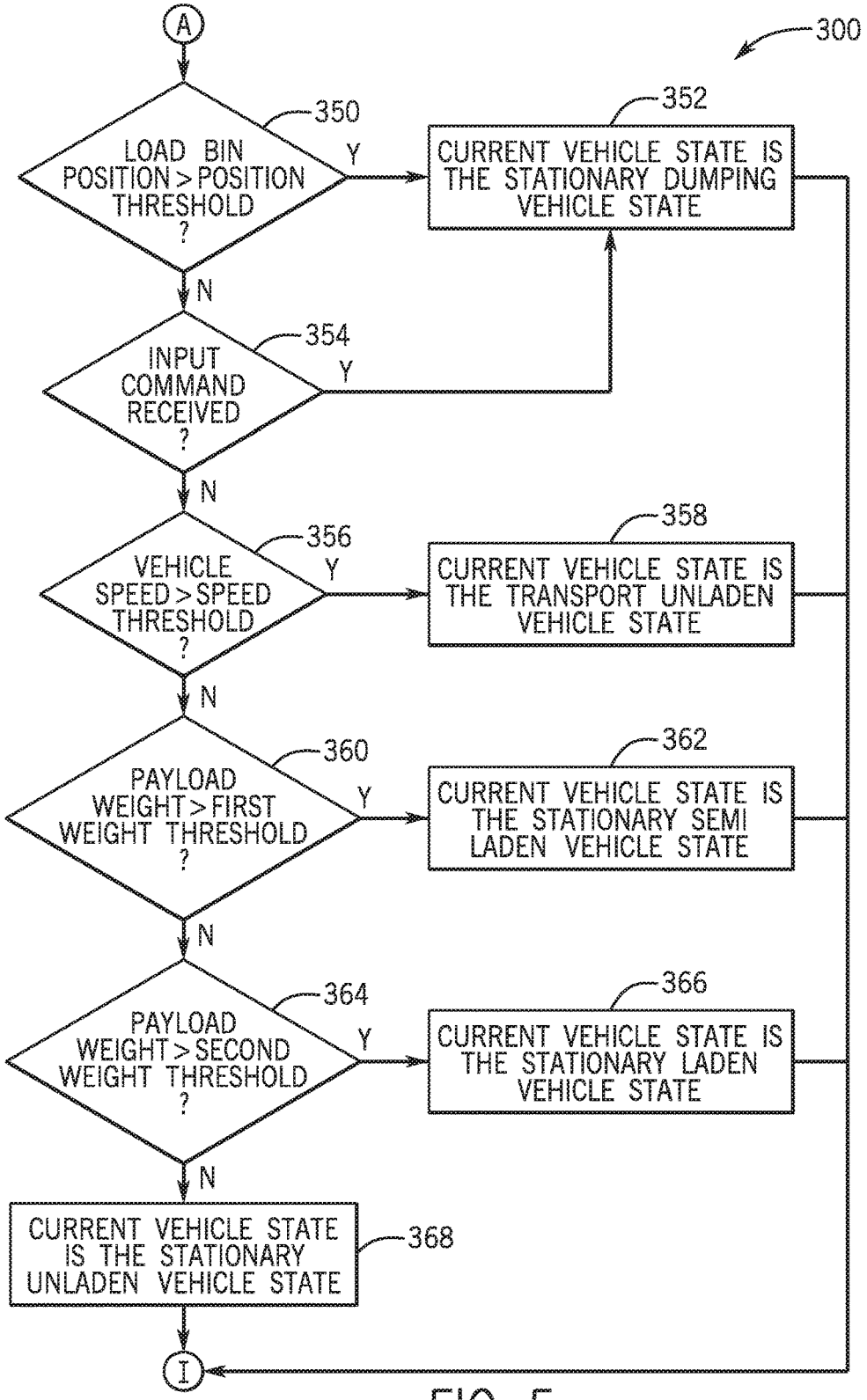
FIG. 5 is a continuation of the flowchart of FIG. 4.

With reference to FIG. 5, from A, the method determines whether the position of the load bin 12 is greater than the position threshold for at least one second at 350, based on the bin position data 120. If true, the method proceeds to 352. Otherwise, at 354, the method determines whether the input command from the bin command data 122 indicates a command to move the load bin 12 from the lowered position L to the raised position R. If true, the method proceeds to 352. At 352, the method retrieves the vehicle state classification 112 from the vehicle state classification datastore 104 and classifies the current vehicle state 128 as the stationary dumping vehicle state.

Otherwise, at 356, the method determines whether the speed of the ADT 10 is greater than the speed threshold for at least one second, based on the speed data 116. If true, at 358, the method retrieves the vehicle state classification 112 from the vehicle state classification datastore 104 and classifies the current vehicle state 128 as the transport unladen vehicle state.

Otherwise, at 360, the method determines whether the weight of the payload in the load bin 12 is greater than the first weight threshold, but less than the second weight threshold for at least two seconds, based on the weight data 124. If true, at 362, the method retrieves the vehicle state classification 112 from the vehicle state classification datastore 104 and classifies the current vehicle state 128 as the stationary semi-laden vehicle state.

Otherwise, at 364, the method determines whether the weight of the payload in the load bin 12 is greater than the second weight threshold for at least two seconds based on the weight data 124. If true, at 366, the method retrieves the vehicle state classification 112 from the vehicle state classification datastore 104 and classifies the current vehicle state 128 as the stationary laden vehicle state. Otherwise, at 368, the current vehicle state 128 remains set as the stationary unladen vehicle state. The method loops to I on FIG. 4.

Figure 6:
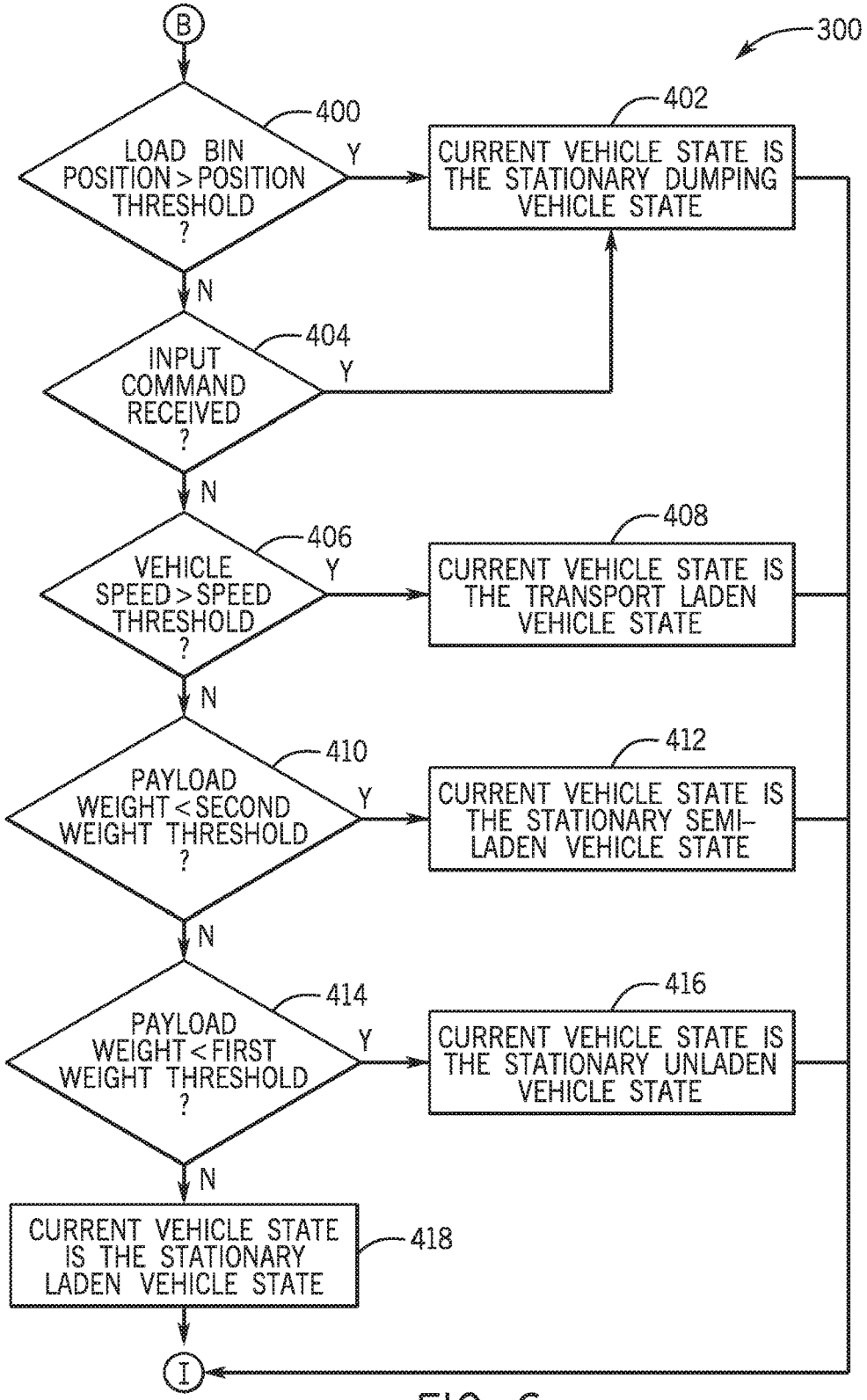
FIG. 6 is a continuation of the flowchart of FIG. 4.

With reference to FIG. 6, from B, the method determines whether the position of the load bin 12 is greater than the position threshold for at least one second at 400, based on the bin position data 120. If true, the method proceeds to 402. Otherwise, at 404, the method determines whether the input command from the bin command data 122 indicates a command to move the load bin 12 from the lowered position L to the raised position R. If true, the method proceeds to 402. At 402, the method retrieves the vehicle state classification 112 from the vehicle state classification datastore 104 and classifies the current vehicle state 128 as the stationary dumping vehicle state.

Otherwise, at 406, the method determines whether the speed of the ADT 10 is greater than the speed threshold for at least one second, based on the speed data 116. If true, at 408, the method retrieves the vehicle state classification 112 from the vehicle state classification datastore 104 and classifies the current vehicle state 128 as the transport laden vehicle state.

Otherwise, at 410, the method determines whether the weight of the payload in the load bin 12 is less than the second weight threshold, but is greater than the first weight threshold for at least two seconds, based on the weight data 124. If true, at 412, the method retrieves the vehicle state classification 112 from the vehicle state classification datastore 104 and classifies the current vehicle state 128 as the stationary semi-laden vehicle state.

Otherwise, at 414, the method determines whether the weight of the payload in the load bin 12 is less than the first weight threshold for at least two seconds based on the weight data 124. If true, at 416, the method retrieves the vehicle state classification 112 from the vehicle state classification datastore 104 and classifies the current vehicle state 128 as the stationary unladen vehicle state. Otherwise, at 418, the current vehicle state 128 remains set as the stationary laden vehicle state. The method loops to I on FIG. 4.

Figure 7:
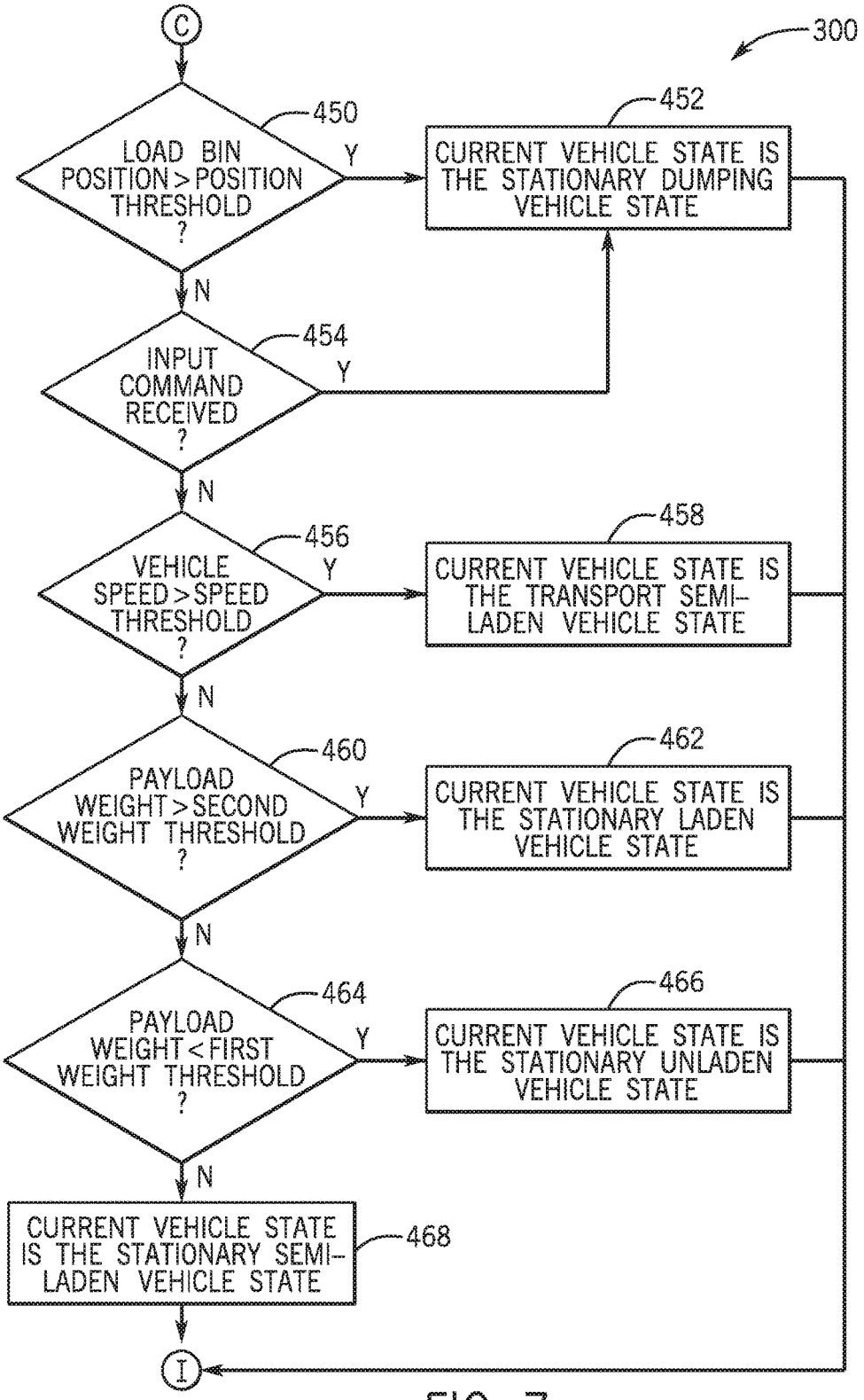
FIG. 7 is a continuation of the flowchart of FIG. 4.

With reference to FIG. 7, from C, the method determines whether the position of the load bin 12 is greater than the position threshold for at least one second at 450, based on the bin position data 120. If true, the method proceeds to 452. Otherwise, at 454, the method determines whether the input command from the bin command data 122 indicates a command to move the load bin 12 from the lowered position L to the raised position R. If true, the method proceeds to 452. At 452, the method retrieves the vehicle state classification 112 from the vehicle state classification datastore 104 and classifies the current vehicle state 128 as the stationary dumping vehicle state.

Otherwise, at 456, the method determines whether the speed of the ADT 10 is greater than the speed threshold for at least one second, based on the speed data 116. If true, at 458, the method retrieves the vehicle state classification 112 from the vehicle state classification datastore 104 and classifies the current vehicle state 128 as the transport semi-laden vehicle state.

Otherwise, at 460, the method determines whether the weight of the payload in the load bin 12 is greater than the second weight threshold for at least two seconds, based on the weight data 124. If true, at 462, the method retrieves the vehicle state classification 112 from the vehicle state classification datastore 104 and classifies the current vehicle state 128 as the stationary laden vehicle state.

Otherwise, at 464, the method determines whether the weight of the payload in the load bin 12 is less than the first weight threshold for at least two seconds based on the weight data 124. If true, at 466, the method retrieves the vehicle state classification 112 from the vehicle state classification datastore 104 and classifies the current vehicle state 128 as the stationary unladen vehicle state. Otherwise, at 468, the current vehicle state 128 remains set as the stationary semi-laden vehicle state. The method loops to I on FIG. 4.

Figure 8:
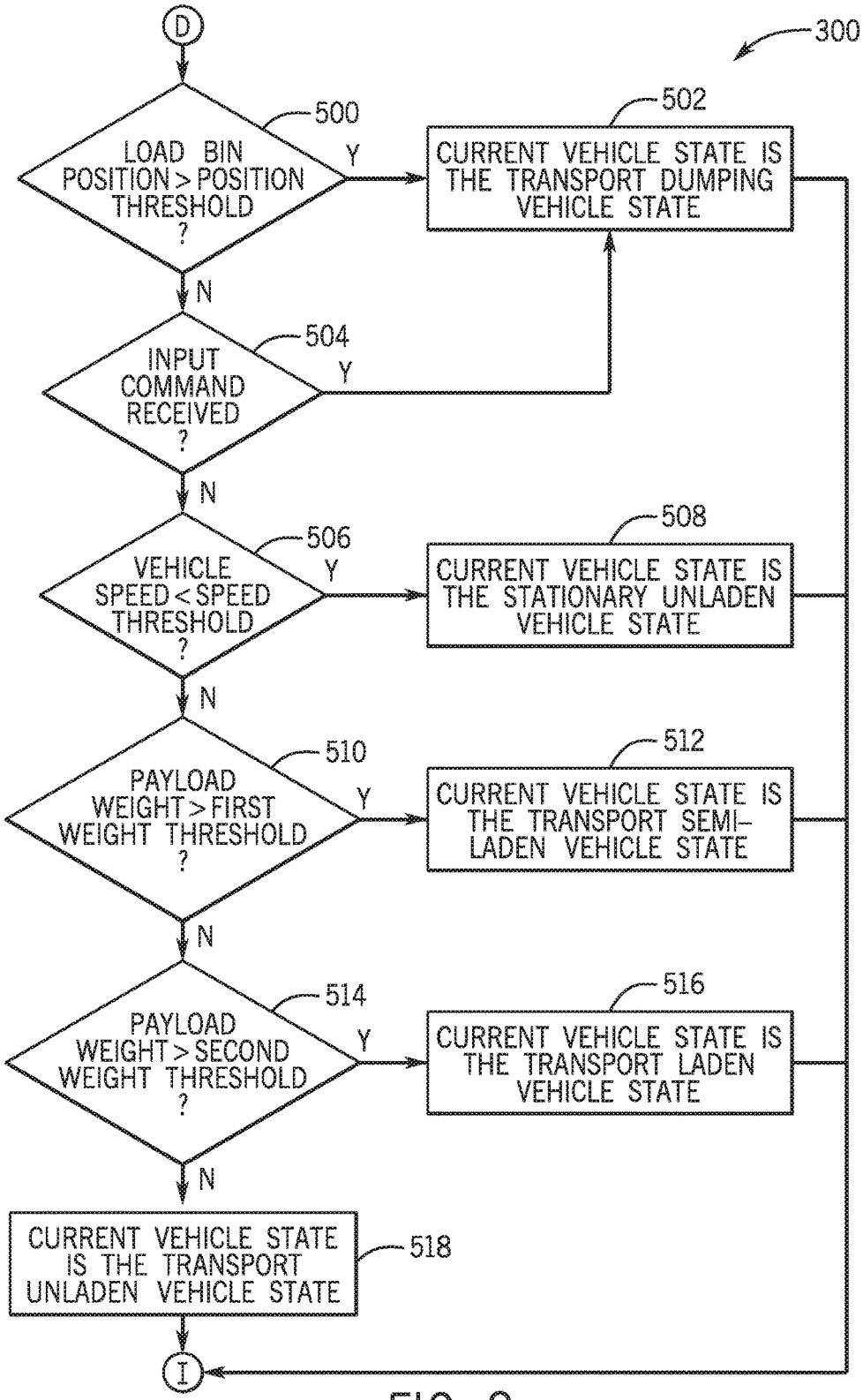
FIG. 8 is a continuation of the flowchart of FIG. 4.

With reference to FIG. 8, from D, the method determines whether the position of the load bin 12 is greater than the position threshold for at least one second at 500, based on the bin position data 120. If true, the method proceeds to 502. Otherwise, at 504, the method determines whether the input command from the bin command data 122 indicates a command to move the load bin 12 from the lowered position L to the raised position R. If true, the method proceeds to 502. At 502, the method retrieves the vehicle state classification 112 from the vehicle state classification datastore 104 and classifies the current vehicle state 128 as the transport dumping vehicle state.

Otherwise, at 506, the method determines whether the speed of the ADT 10 is less than the speed threshold for at least one second, based on the speed data 116. If true, at 508, the method retrieves the vehicle state classification 112 from the vehicle state classification datastore 104 and classifies the current vehicle state 128 as the stationary unladen vehicle state.

Otherwise, at 510, the method determines whether the weight of the payload in the load bin 12 is greater than the first weight threshold, but less than the second weight threshold, for at least two seconds, based on the weight data 124. If true, at 512, the method retrieves the vehicle state classification 112 from the vehicle state classification datastore 104 and classifies the current vehicle state 128 as the transport semi-laden vehicle state.

Otherwise, at 514, the method determines whether the weight of the payload in the load bin 12 is greater than the second weight threshold for at least two seconds based on the weight data 124. If true, at 516, the method retrieves the vehicle state classification 112 from the vehicle state classification datastore 104 and classifies the current vehicle state 128 as the transport laden vehicle state. Otherwise, at 518, the current vehicle state 128 remains set as the transport unladen vehicle state. The method loops to I on FIG. 4.

Figure 9:
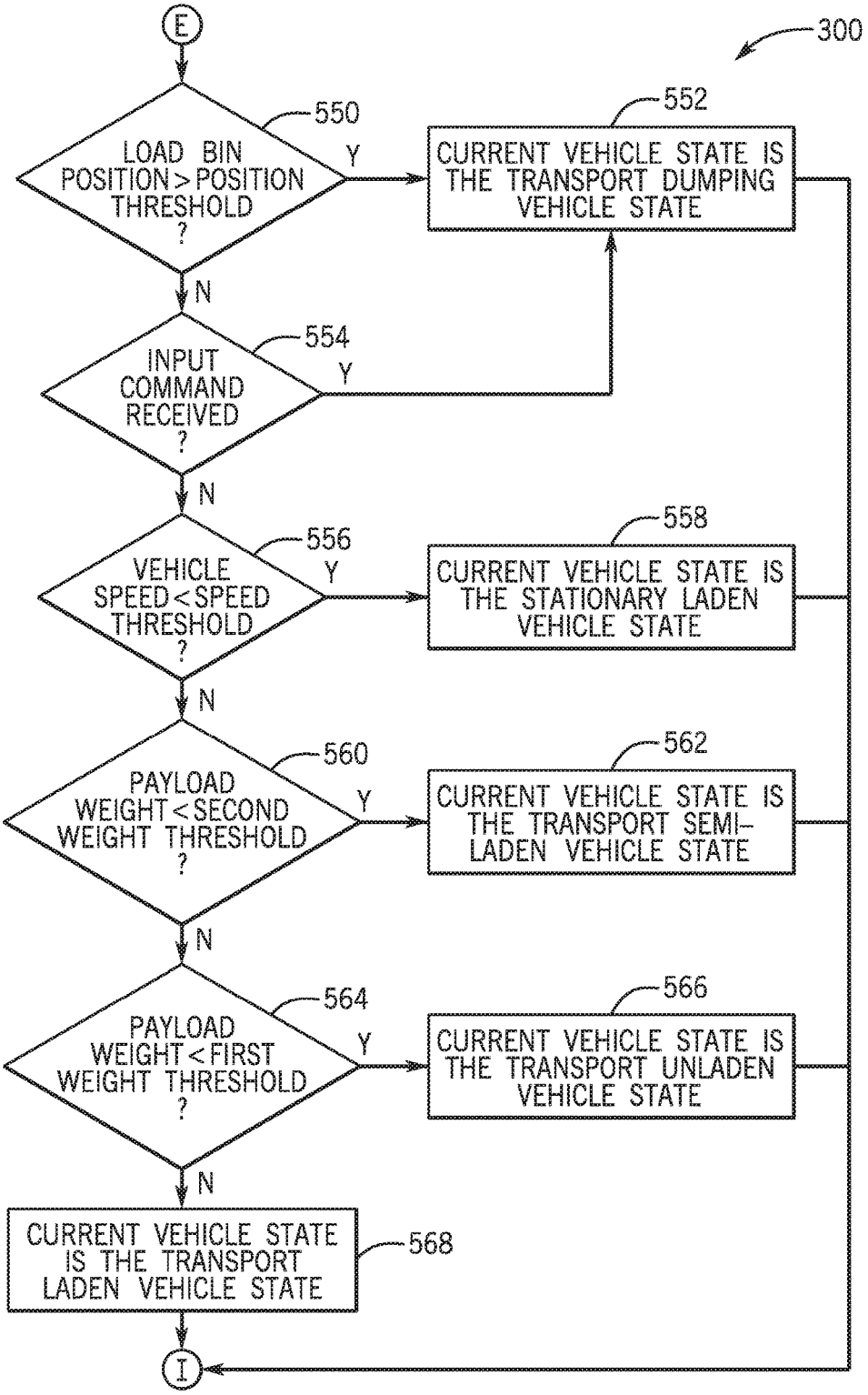
FIG. 9 is a continuation of the flowchart of FIG. 4.

With reference to FIG. 9, from E, the method determines whether the position of the load bin 12 is greater than the position threshold for at least one second at 550, based on the bin position data 120. If true, the method proceeds to 552. Otherwise, at 554, the method determines whether the input command from the bin command data 122 indicates a command to move the load bin 12 from the lowered position L to the raised position R. If true, the method proceeds to 552. At 552, the method retrieves the vehicle state classification 112 from the vehicle state classification datastore 104 and classifies the current vehicle state 128 as the transport dumping vehicle state.

Otherwise, at 556, the method determines whether the speed of the ADT 10 is less than the speed threshold for at least one second, based on the speed data 116. If true, at 558, the method retrieves the vehicle state classification 112 from the vehicle state classification datastore 104 and classifies the current vehicle state 128 as the stationary laden vehicle state.

Otherwise, at 560, the method determines whether the weight of the payload in the load bin 12 is less than the second weight threshold, but greater than the first weight threshold, for at least two seconds, based on the weight data 124. If true, at 562, the method retrieves the vehicle state classification 112 from the vehicle state classification datastore 104 and classifies the current vehicle state 128 as the transport semi-laden vehicle state.

Otherwise, at 564, the method determines whether the weight of the payload in the load bin 12 is less than the first weight threshold for at least two seconds based on the weight data 124. If true, at 566, the method retrieves the vehicle state classification 112 from the vehicle state classification datastore 104 and classifies the current vehicle state 128 as the transport unladen vehicle state. Otherwise, at 568, the current vehicle state 128 remains set as the transport laden vehicle state. The method loops to I on FIG. 4.

With reference to FIG. 10, from F, the method determines whether the position of the load bin 12 is less than the position threshold for at least one second at 600, based on the bin position data 120. If true, the method proceeds to 602. Otherwise, at 604, the method determines whether the input command from the bin command data 122 indicates a command to move the load bin 12 from the raised position R to the lowered position L. If true, the method proceeds to 602. At 602, the method determines whether the weight of the payload in the load bin 12 is less than the first weight threshold for at least one second, based on the weight data 124. If true, at 606, the method retrieves the vehicle state classification 112 from the vehicle state classification datastore 104 and classifies the current vehicle state 128 as the stationary unladen vehicle state.

Otherwise, at 608, the method determines whether the weight of the payload in the load bin 12 is less than the second weight threshold for at least two seconds based on the weight data 124. If true, at 610, the method retrieves the vehicle state classification 112 from the vehicle state classification datastore 104 and classifies the current vehicle state 128 as the stationary semi-laden vehicle state. Otherwise, at 612, the method retrieves the vehicle state classification 112 from the vehicle state classification datastore 104 and classifies the current vehicle state 128 as the stationary laden vehicle state.

If the input command is not received at 604, at 614, the method determines whether the speed of the ADT 10 is greater than the speed threshold for at least one second, based on the speed data 116. If true, at 616, the method retrieves the vehicle state classification 112 from the vehicle state classification datastore 104 and classifies the current vehicle state 128 as the transport dumping vehicle state.

Otherwise, at 618, the current vehicle state 128 remains set as the stationary dumping vehicle state. The method loops to I on FIG. 4.

Figure 11:
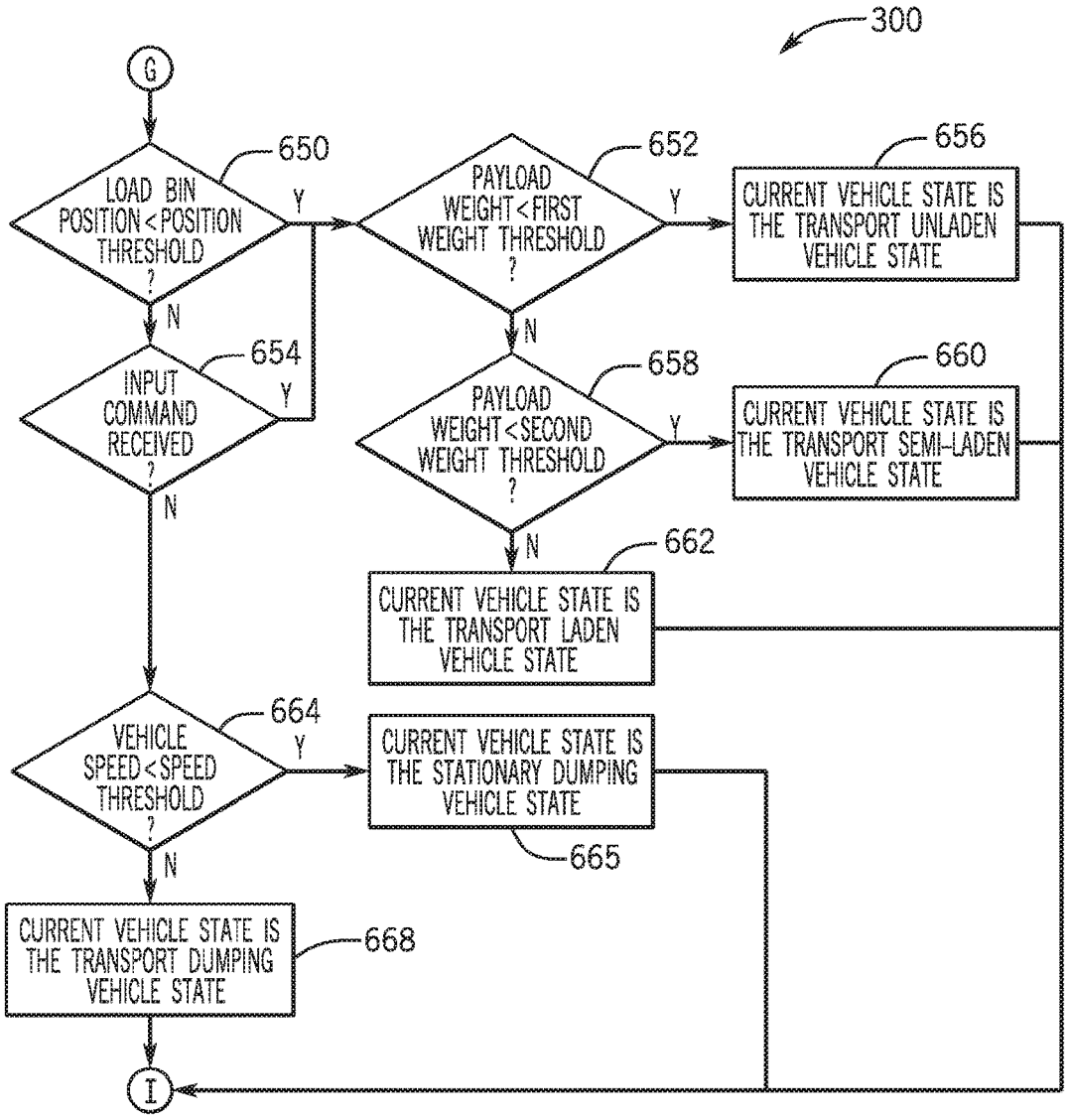
FIG. 11 is a continuation of the flowchart of FIG. 4.

With reference to FIG. 11, from G, the method determines whether the position of the load bin 12 is less than the position threshold for at least one second at 650, based on the bin position data 120. If true, the method proceeds to 652. Otherwise, at 654, the method determines whether the input command from the bin command data 122 indicates a command to move the load bin 12 from the raised position R to the lowered position L. If true, the method proceeds to 652. At 652, the method determines whether the weight of the payload in the load bin 12 is less than the first weight threshold for at least one second, based on the weight data 124. If true, at 656, the method retrieves the vehicle state classification 112 from the vehicle state classification datastore 104 and classifies the current vehicle state 128 as the transport unladen vehicle state.

Otherwise, at 658, the method determines whether the weight of the payload in the load bin 12 is less than the second weight threshold for at least two seconds based on the weight data 124. If true, at 660, the method retrieves the vehicle state classification 112 from the vehicle state classification datastore 104 and classifies the current vehicle state 128 as the transport semi-laden vehicle state. Otherwise, at 662, the method retrieves the vehicle state classification 112 from the vehicle state classification datastore 104 and classifies the current vehicle state 128 as the transport laden vehicle state.

If the input command is not received at 654, at 664, the method determines whether the speed of the ADT 10 is less than the speed threshold for at least one second, based on the speed data 116. If true, at 665, the method retrieves the vehicle state classification 112 from the vehicle state classification datastore 104 and classifies the current vehicle state 128 as the stationary dumping vehicle state.

Otherwise, at 668, the current vehicle state 128 remains set as the transport dumping vehicle state. The method loops to I on FIG. 4.

Figure 12:
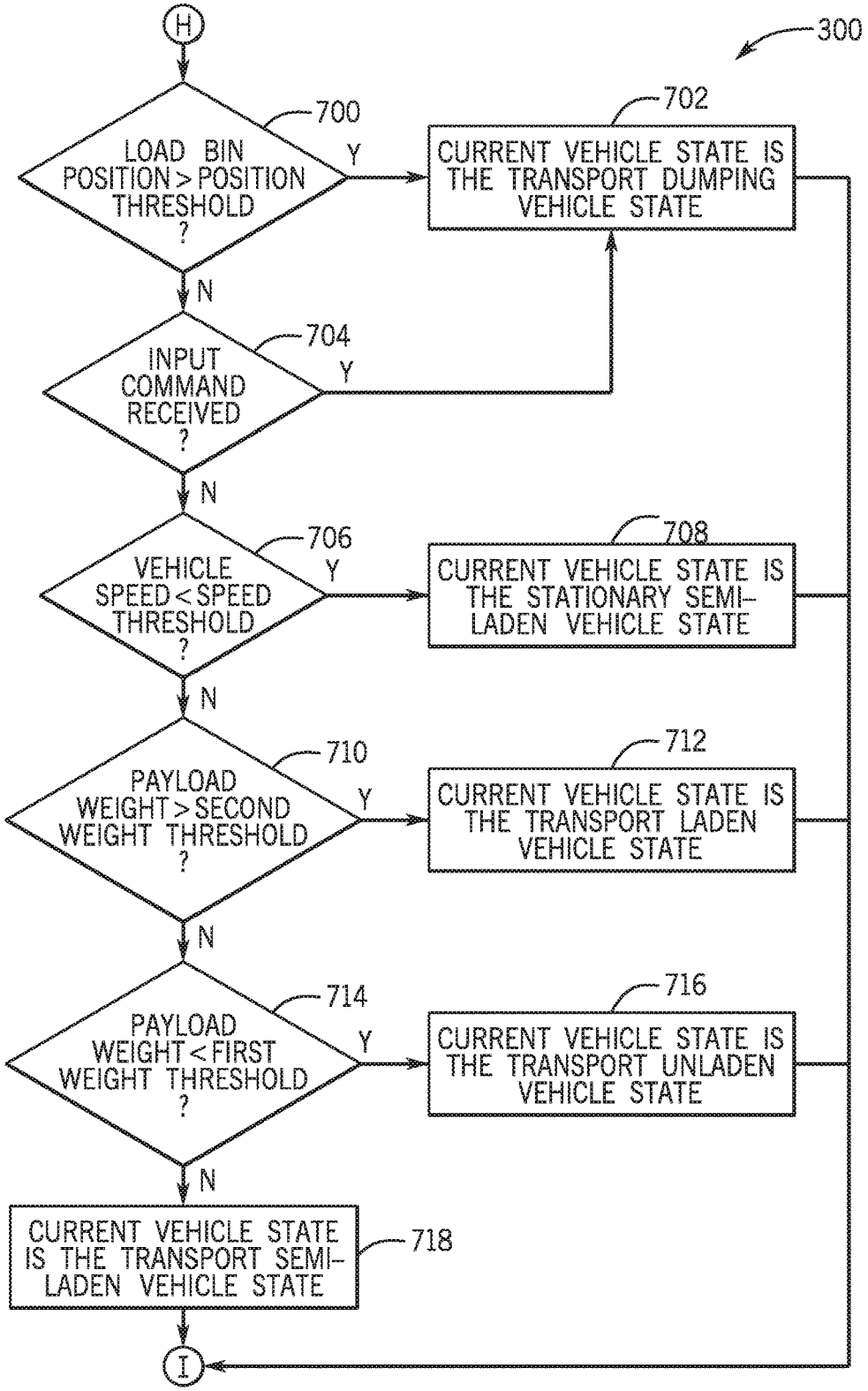
FIG. 12 is a continuation of the flowchart of FIG. 4.

With reference to FIG. 12, from H, the method determines whether the position of the load bin 12 is greater than the position threshold for at least one second at 700, based on the bin position data 120. If true, the method proceeds to 702. Otherwise, at 704, the method determines whether the input command from the bin command data 122 indicates a command to move the load bin 12 from the lowered position L to the raised position R. If true, the method proceeds to 702. At 702, the method retrieves the vehicle state classification 112 from the vehicle state classification datastore 104 and classifies the current vehicle state 128 as the transport dumping vehicle state.

Otherwise, at 706, the method determines whether the speed of the ADT 10 is less than the speed threshold for at least one second, based on the speed data 116. If true, at 708, the method retrieves the vehicle state classification 112 from the vehicle state classification datastore 104 and classifies the current vehicle state 128 as the stationary semi-laden vehicle state.

Otherwise, at 710, the method determines whether the weight of the payload in the load bin 12 is greater than the second weight threshold for at least two seconds, based on the weight data 124. If true, at 712, the method retrieves the vehicle state classification 112 from the vehicle state classification datastore 104 and classifies the current vehicle state 128 as the transport laden vehicle state.

Otherwise, at 714, the method determines whether the weight of the payload in the load bin 12 is less than the first weight threshold for at least two seconds based on the weight data 124. If true, at 716, the method retrieves the vehicle state classification 112 from the vehicle state classification datastore 104 and classifies the current vehicle state 128 as the transport unladen vehicle state. Otherwise, at 718, the current vehicle state 128 remains set as the transport semi-laden vehicle state. The method loops to I on FIG. 4.

Figure 13:
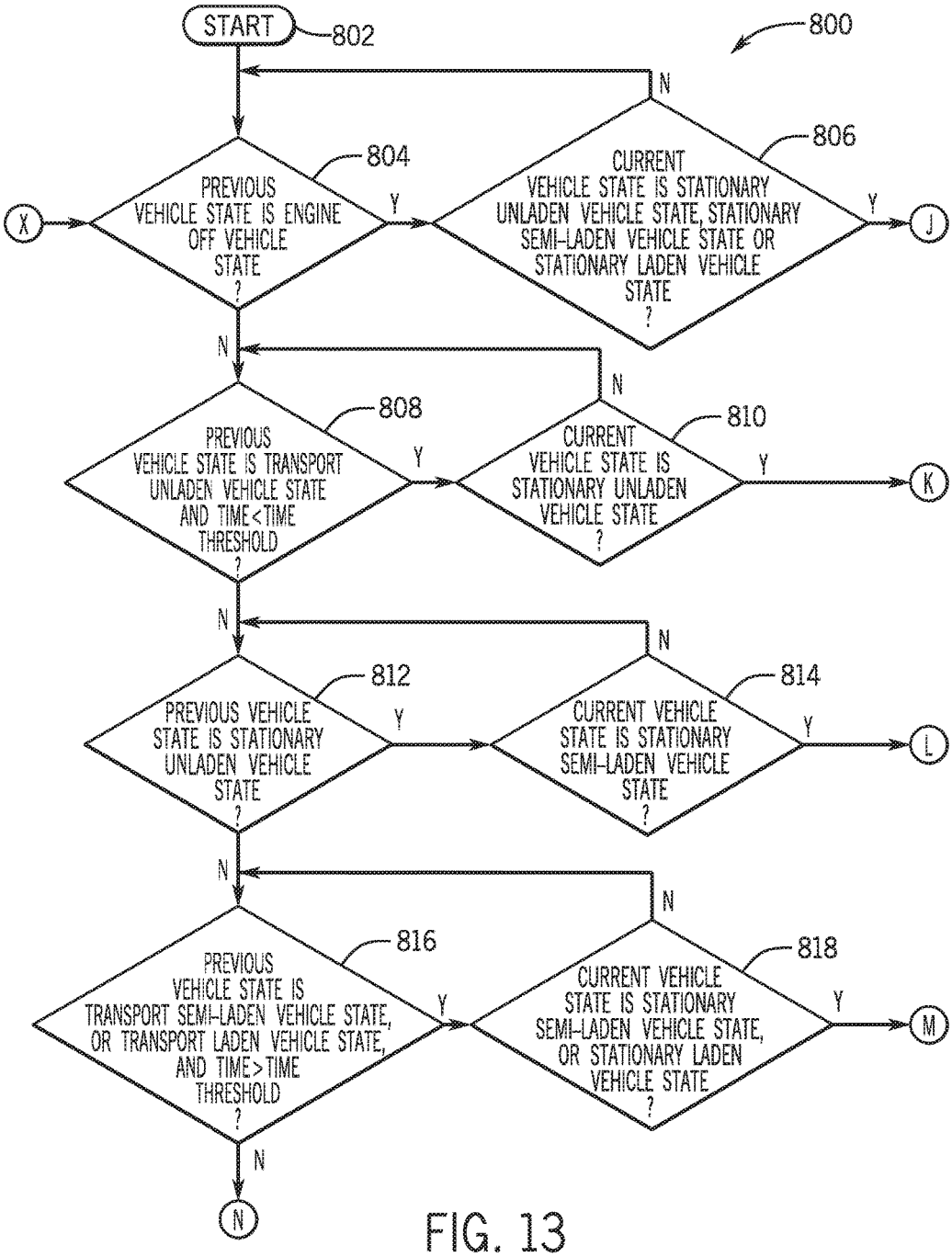
FIG. 13 is a flowchart illustrating an example method for determining an idle state based on the determined vehicle state in accordance with various embodiments.

With reference back to FIG. 3, at 208, based on the determined vehicle states, the time data 136 and the park brake data 132, the method determines and classifies one or more idle states. It should be understood that while blocks 206 and 208 are illustrated sequentially, blocks 206 and 208 can be performed substantially simultaneously. With reference to FIG. 13, a flowchart illustrates an exemplary method 800 for determining and classifying the one or more idle states that can be performed by the idle state determination control module 80 of the controller 44 of FIGS. 1 and 2 in accordance with the present disclosure. As can be appreciated in light of the disclosure, the order of operation within the method is not limited to the sequential execution as illustrated in FIG. 13, but may be performed in one or more varying orders as applicable and in accordance with the present disclosure.

The method begins at 802. At 804, the method determines whether the previous vehicle state was the engine off vehicle state. If true, at 806, the method determines whether the current vehicle state 128 is one of the stationary unladen vehicle state, the stationary semi-laden vehicle state or the stationary laden vehicle state. If true, the method determines an idle state and proceeds to J on FIG. 14. Otherwise, the method loops.

If the previous vehicle state is not the engine off vehicle state, at 808, the method determines whether the previous vehicle state was the transport unladen vehicle state, and a time of the previous vehicle state was less than the first time threshold. If true, the method proceeds to 810. At 810, the method determines whether the current vehicle state 128 is the stationary unladen vehicle state. If true, the method determines an idle state and proceeds to K on FIG. 15. Otherwise, the method loops.

If the previous vehicle state is not the transport unladen vehicle state, at 812, the method determines whether the previous vehicle state was the stationary unladen vehicle state. If true, the method proceeds to 814. At 814, the method determines whether the current vehicle state 128 is the stationary semi-laden vehicle state. If true, the method determines an idle state and proceeds to L on FIG. 16. Otherwise, the method loops.

If the previous vehicle state is not the stationary unladen vehicle state, at 816, the method determines whether the previous vehicle state was the transport semi-laden vehicle state or the transport laden vehicle state; and if the time of the previous vehicle state 128 was greater than the time threshold. If true, at 818, the method determines whether the current vehicle state 128 is the stationary semi-laden vehicle state or the stationary laden vehicle state. If true, the method proceeds to M on FIG. 17. Otherwise, the method loops. If the previous state is not the transport semi-laden vehicle state or the transport laden vehicle state, the method determines an idle state and proceeds to N on FIG. 18.

Figure 18:
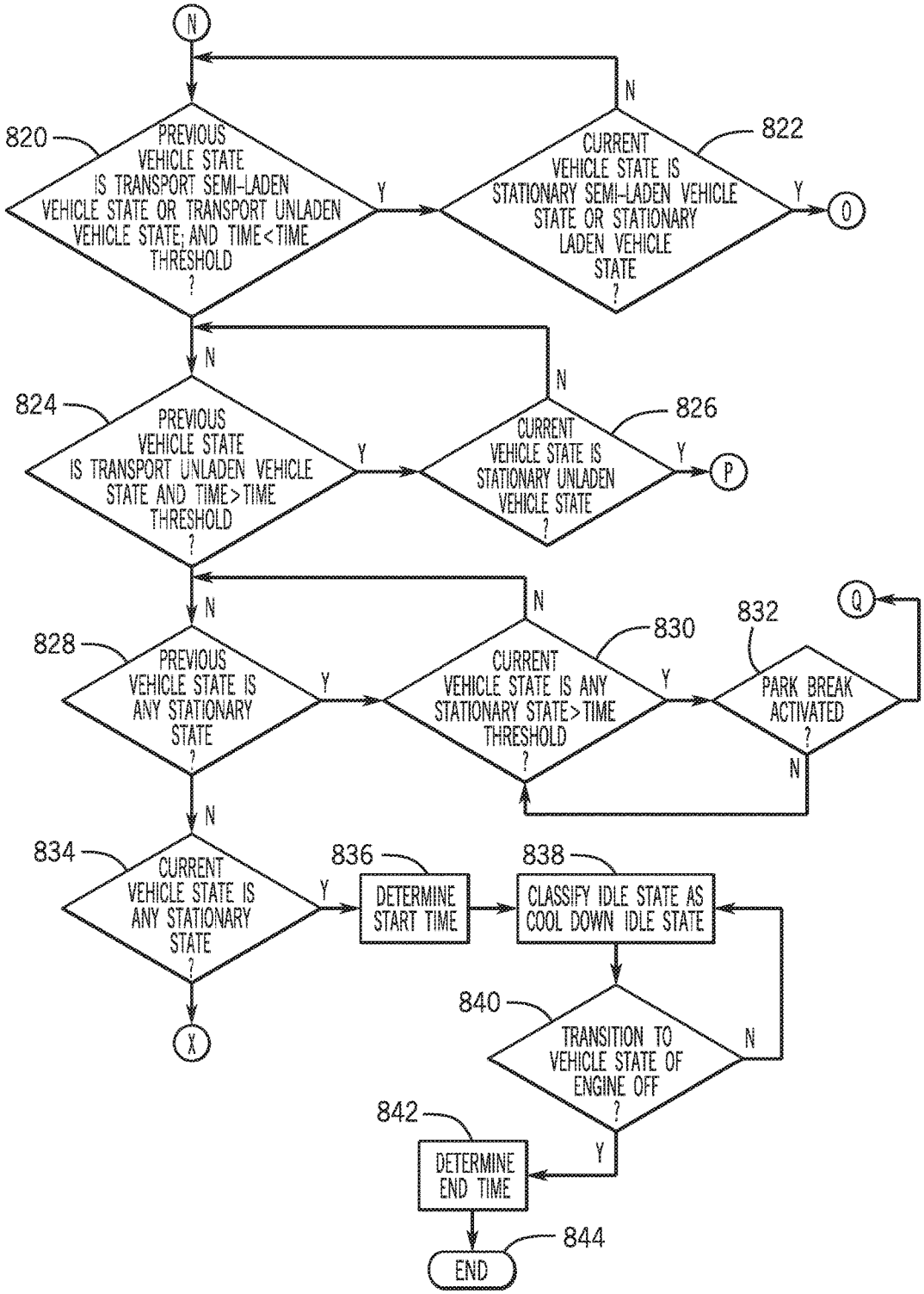
FIG. 18 is a continuation of the flowchart of FIG. 13.

With reference to FIG. 18, from N, at 820, the method determines whether the previous vehicle state was the transport semi-laden vehicle state or the transport unladen vehicle state; and if the time of the previous vehicle state was less than the time threshold. If true, at 822, the method determines whether the current vehicle state 128 is the stationary semi-laden vehicle state or the stationary laden vehicle state. If true, the method determines an idle state and proceeds to O on FIG. 19. Otherwise, the method loops.

At 824, the method determines whether the previous vehicle state was the transport unladen vehicle state; and if the time of the previous vehicle state was greater than the time threshold (determined based on the time data 136). If true, at 826, the method determines whether the current vehicle state 128 is the stationary unladen vehicle state. If true, the method determines an idle state and proceeds to P on FIG. 20. Otherwise, the method loops.

At 828, the method determines whether the previous vehicle state was the stationary unladen vehicle state, the stationary semi-laden vehicle state or the stationary laden vehicle state. If true, at 830, the method determines whether the current vehicle state 128 is the stationary unladen vehicle state, the stationary semi-laden vehicle state or the stationary laden vehicle state; and if the time of the current vehicle state 128 is greater than the second time threshold. If true, at 832, the method determines, based on the park brake data 132, whether the park brake status is activated. If the park brake has been activated, the method determines an idle state and proceeds to Q on FIG. 21. Otherwise, the method loops.

At 834, the method determines whether the current vehicle state 128 is the stationary unladen vehicle state, the stationary semi-laden vehicle state or the stationary laden vehicle state. If false, the method loops to X on FIG. 13. If true, at 836, the method determines an idle state and determines a start time based on the time data 136. At 838, the method retrieves the idle state classification 130 from the idle state classification datastore 108 and classifies the determined idle state as the cool down idle state. At 840, the method determines whether the current vehicle state 128 has transitioned to the engine off vehicle state. If true, at 842, the method determines an end time of the cool down idle state. The method ends at 844.

Figure 14:
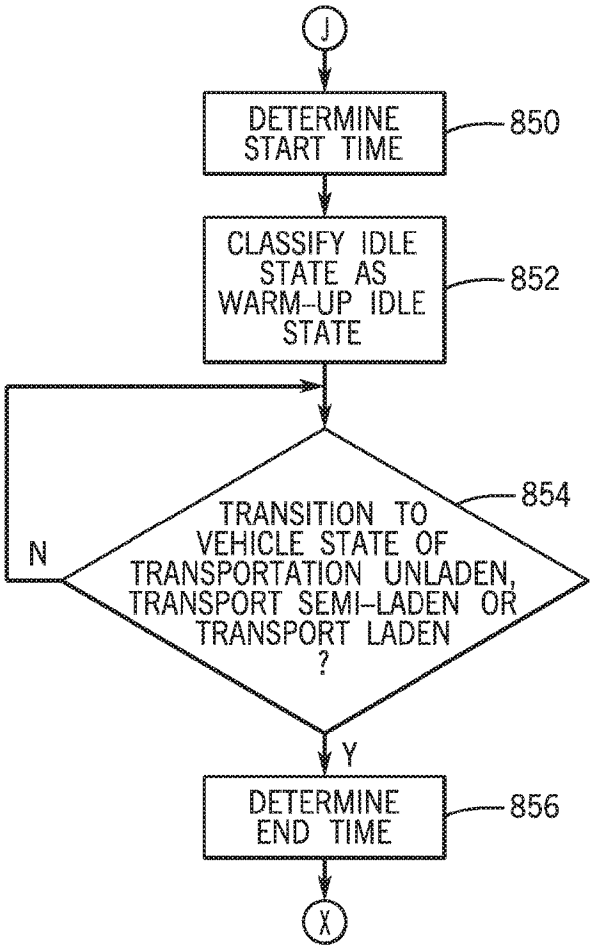
FIG. 14 is a continuation of the flowchart of FIG. 13.

With reference to FIG. 14, from J, the method determines a start time of the determined idle state based on the time data 136 at 850. At 852, the method retrieves the idle state classification 130 from the idle state classification datastore 108 and classifies the determined idle state as the warm-up idle state. At 854, the method determines whether a transition in the current vehicle state 128 to the transport unladen vehicle state, the transport semi-laden vehicle state or the transport laden vehicle state has occurred. If true, the method determines the end time of the warm-up idle state at 856, and proceeds to X on FIG. 13. Otherwise, the method loops.

Figure 15:
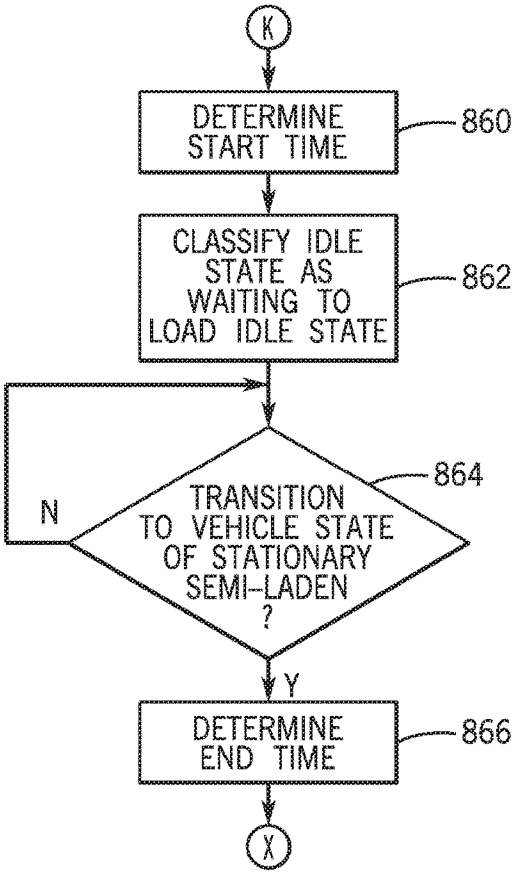
FIG. 15 is a continuation of the flowchart of FIG. 13.

With reference to FIG. 15, from K, the method determines a start time of the determined idle state based on the time data 136 at 860. At 862, the method retrieves the idle state classification 130 from the idle state classification datastore 108 and classifies the determined idle state as the waiting to load idle state. At 864, the method determines whether a transition in the current vehicle state 128 to the stationary semi-laden vehicle state has occurred. If true, the method determines the end time of the waiting to load idle state at 866, and proceeds to X on FIG. 13. Otherwise, the method loops.

Figure 16:
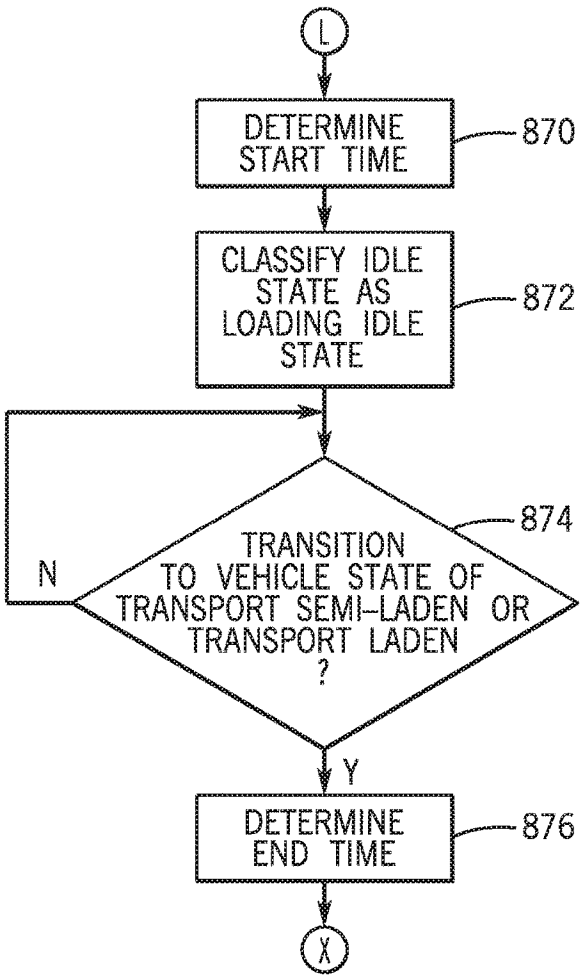
FIG. 16 is a continuation of the flowchart of FIG. 13.

With reference to FIG. 16, from L, the method determines a start time of the determined idle state based on the time data 136 at 870. At 872, the method retrieves the idle state classification 130 from the idle state classification datastore 108 and classifies the determined idle state as the loading idle state. At 874, the method determines whether a transition in the current vehicle state 128 to the transport semi-laden vehicle state or transport laden vehicle state has occurred. If true, the method determines the end time of the loading idle state at 876, and proceeds to X on FIG. 13. Otherwise, the method loops.

Figure 17:
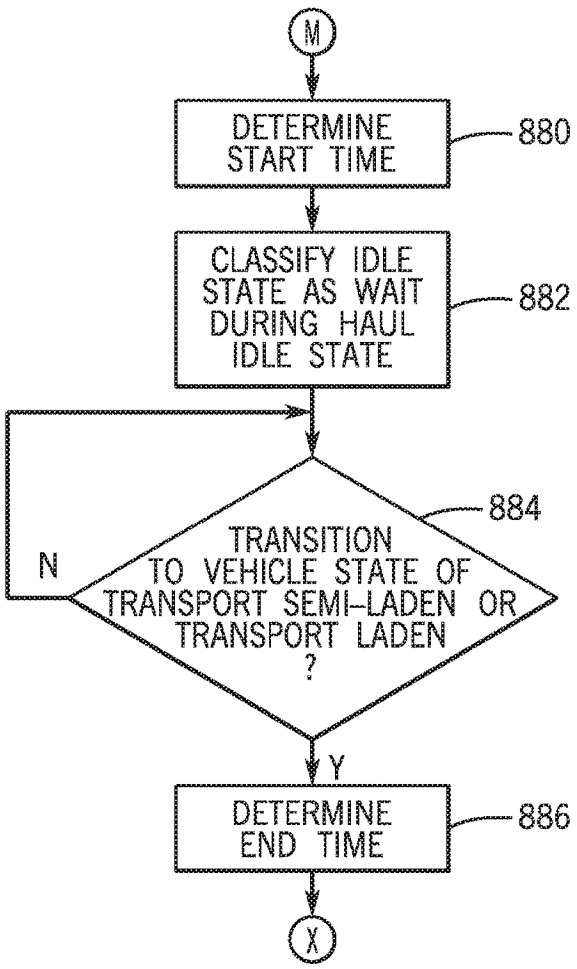
FIG. 17 is a continuation of the flowchart of FIG. 13.

With reference to FIG. 17, from M, the method determines a start time of the determined idle state based on the time data 136 at 880. At 882, the method retrieves the idle state classification 130 from the idle state classification datastore 108 and classifies the determined idle state as the wait during haul idle state. At 884, the method determines whether a transition in the current vehicle state 128 to the transport semi-laden vehicle state or transport laden vehicle state has occurred. If true, the method determines the end time of the wait during haul idle state at 886, and proceeds to X on FIG. 13. Otherwise, the method loops.

Figure 19:
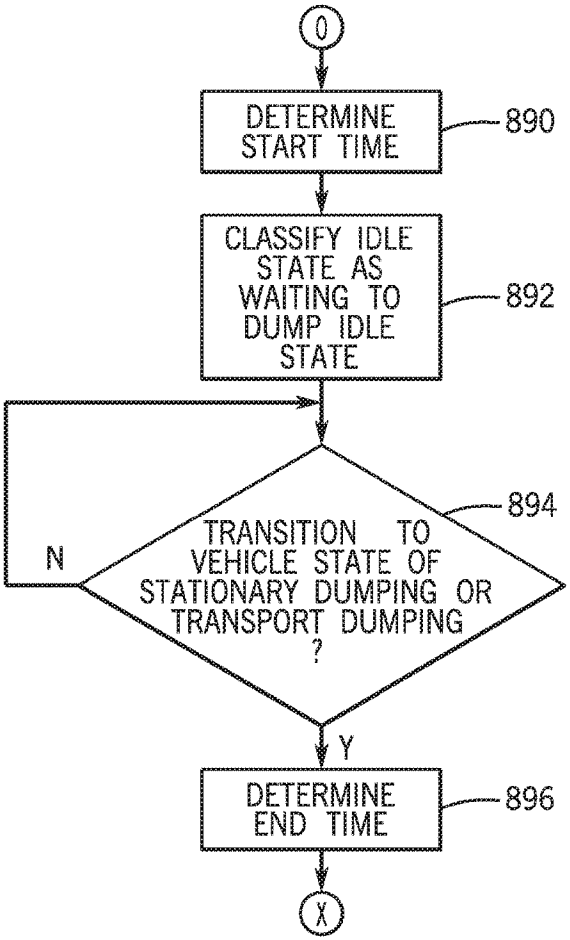
FIG. 19 is a continuation of the flowchart of FIG. 13.

With reference to FIG. 19, from O, the method determines a start time of the determined idle state based on the time data 136 at 890. At 892, the method retrieves the idle state classification 130 from the idle state classification datastore 108 and classifies the determined idle state as the waiting to dump idle state. At 894, the method determines whether a transition in the current vehicle state 128 to the stationary dumping vehicle state or transport dumping vehicle state has occurred. If true, the method determines the end time of the waiting to dump idle state at 896, and proceeds to X on FIG. 13. Otherwise, the method loops.

Figure 20:
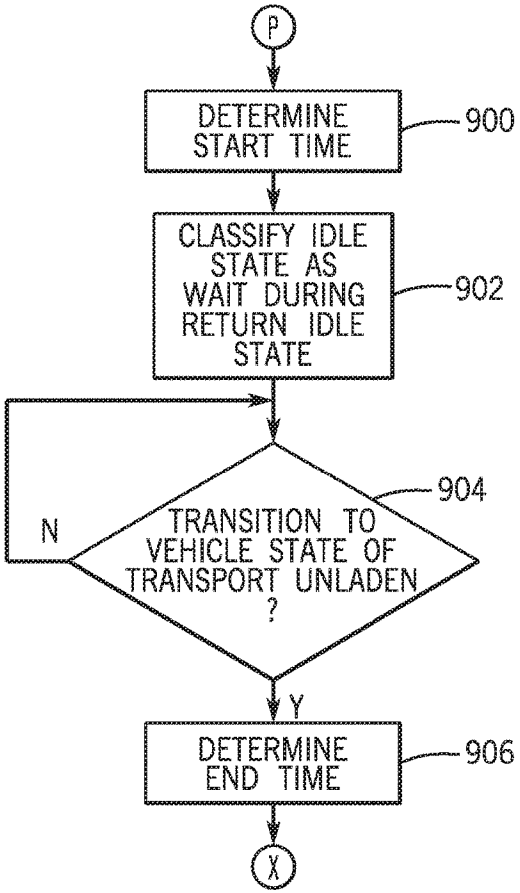
FIG. 20 is a continuation of the flowchart of FIG. 13.

With reference to FIG. 20, from P, the method determines a start time of the determined idle state based on the time data 136 at 900. At 902, the method retrieves the idle state classification 130 from the idle state classification datastore 108 and classifies the determined idle state as the wait during return idle state. At 904, the method determines whether a transition in the current vehicle state 128 to the transport unladen vehicle state has occurred. If true, the method determines the end time of the wait during return idle state at 906, and proceeds to X on FIG. 13. Otherwise, the method loops.

Figure 21:
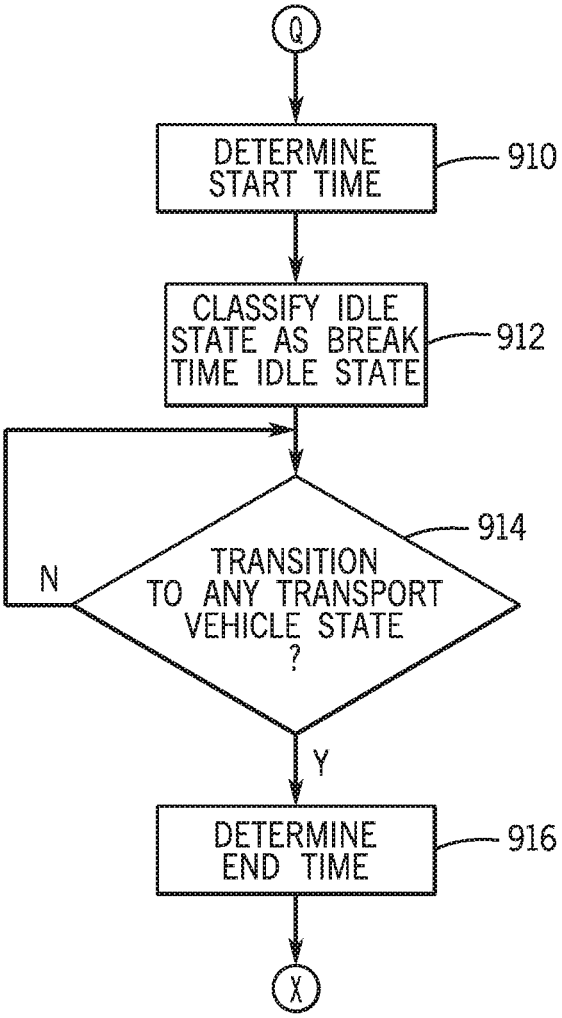
FIG. 21 is a continuation of the flowchart of FIG. 13.

With reference to FIG. 21, from Q, the method determines a start time of the determined idle state based on the time data 136 at 910. At 912, the method retrieves the idle state classification 130 from the idle state classification datastore 108 and classifies the determined idle state as the break time idle state. At 914, the method determines whether a transition in the current vehicle state 128 to the transport unladen vehicle state, the transport semi-laden vehicle state or the transport laden vehicle state has occurred. If true, the method determines the end time of the break time idle state at 916, and proceeds to X on FIG. 13. Otherwise, the method loops.

With reference back to FIG. 3, at 210, the method compiles the received current vehicle states 128 and generates vehicle state data 142. At 212, the method compiles the received current idle states 134 and the associated durations 138, and generates idle state data 144. At 214, the method receives as input the fuel data 140, and generates the fuel consumption data 146 based on the received current idle states 134 and the associated durations 138 during the operation of the ADT 10 for the period. At 216, the method outputs the vehicle state data 142, the idle state data 144 and the fuel consumption data 146 for transmission by the vehicle communication component 60 to the remote processing system 62. The method ends at 218.

As will be appreciated by one skilled in the art, certain aspects of the disclosed subject matter can be embodied as a method, system (e.g., a work vehicle control system included in a work vehicle), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

Any suitable computer usable or computer readable medium can be utilized. The computer usable medium can be a computer readable signal medium or a computer readable storage medium. A computer-usable, or computer-readable, storage medium (including a storage device associated with a computing device or client electronic device) can be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium can be any tangible medium that can contain, or store a program for use by or in connection with the instruction execution system, apparatus, or device.

A computer readable signal medium can include a propagated data signal with computer readable program code embodied therein, for example, in baseband or as part of a carrier wave. Such a propagated signal can take any of a variety of forms, including, but not limited to, electromagnetic, optical, or any suitable combination thereof. A computer readable signal medium can be non-transitory and can be any computer readable medium that is not a computer readable storage medium and that can communicate, propagate, or transport a program for use by or in connection with an instruction execution system, apparatus, or device.

Aspects of certain embodiments are described herein can be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which comprises one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An idle state determination system for a work vehicle having an engine and at least one movable work implement, the movable work implement including a load bin movable between loaded and unloaded positions by a hydraulic circuit, the load bin operable to receive a payload, and the idle state determination system comprising:

sensors associated with one or more of the engine, the load bin and the hydraulic circuit that provide signals containing work vehicle data indicating one or more operational parameters of the work vehicle, the operational parameters including at least a speed of the work vehicle, a state of the engine and a position of the load bin;

a datastore device providing a source of idle state classifications that include a plurality of idle states associated with the work vehicle, the plurality of idle states including at least a waiting idle state and a loading idle state; and a controller that receives the signals from the sensors and processes the work vehicle data to determine an idle state of the work vehicle, wherein the controller communicates with the datastore device and classifies the determined idle state as one of the plurality of idle states.

2. The idle state determination system of claim 1, wherein the controller further determines a duration of the determined idle state based, at least in part, on the work vehicle data indicating a transition in at least one of the speed of the work vehicle and the position of the load bin.

3. The idle state determination system of claim 2, wherein the controller transmits the duration for each of the plurality of idle states to a remote processing system.

4. The idle state determination system of claim 1, wherein the plurality of idle states further comprise a warm-up idle state; and wherein the controller determines the warm-up idle state based on a prior state of the engine as off, a current state of the engine as running and the speed of the work vehicle as below a speed threshold.

5. The idle state determination system of claim 1, wherein the waiting idle state comprises a waiting to load idle state and a waiting to dump idle state, and the operational parameters further include a weight of a payload; and wherein the controller determines the waiting to load idle state based on the speed of the work vehicle as below a speed threshold, the weight of the payload as below a first weight threshold and the weight of the payload as above a second weight threshold.

6. The idle state determination system of claim 5, wherein the controller determines the waiting to dump idle state based on the speed of the work vehicle as below a speed threshold, the weight of the payload as above the first weight threshold and the position of the load bin as above a position threshold.

7. The idle state determination system of claim 1, further comprising a sensor proving a source of a status of a park brake associated with the work vehicle, the plurality of idle states further comprise a break time idle state; and wherein the controller determines the break time idle state based on the speed of the work vehicle as below a speed threshold and the status of the park brake.

8. The idle state determination system of claim 1, wherein the plurality of idle states further comprise a waiting to return idle state, the operational parameters further include a weight of a payload; and wherein the controller determines the waiting to return idle state based on the speed of the work vehicle as below a speed threshold and the weight of the payload as below a first weight threshold.

9. The idle state determination system of claim 1, wherein the plurality of idle states include at least three of: warm-up idle state, waiting to load idle state, waiting to dump idle state, wait during haul idle state, waiting to dump idle state, waiting during return idle state and cool down idle state.

10. A method for determining an idle state for a work vehicle having an engine, a drivetrain and at least one movable work implement, the movable work implement including a load bin movable between loaded and unloaded positions by a hydraulic circuit, the load bin operable to receive a payload, the method comprising:

receiving signals containing one or more operational parameters associated with the work vehicle from sensors associated with one or more of the engine, the load bin and the hydraulic circuit;

determining, by a processor, a state of the work vehicle based on the operational parameters, the state of the work vehicle comprising one of a plurality of vehicle states including an engine off state, at least one of a stationary state and at least one of a transport state;

determining, by the processor, a transition in the state of the work vehicle;

determining, by the processor, an idle state based on the determined transition;

communicating, by the processor, with a datastore device containing a plurality of idle states associated with the work vehicle, the plurality of idle states including at least a warm-up idle state, a waiting to load idle state, a loading idle state, a waiting to dump idle state and a cool-down idle state; and classifying, by the processor, the determined idle state based on one of the plurality of idle states stored in the datastore device.

11. The method of claim 10, further comprising:

determining, by the processor, a subsequent transition in the state of the work vehicle; and determining a duration of the idle state, by the processor, based on determined subsequent transition.

12. The method of claim 11, further comprising:

repeating the determining of the idle state, the determining of the duration of the idle state and the classifying of the determined idle state for each determined subsequent transition in the state of the work vehicle over a period of operation of the work vehicle.

13. The method of claim 12, further comprising:

transmitting, by the processor, the duration for each of the plurality of idle states over the period of operation of the work vehicle to a remote processing system.

14. The method of claim 13, further comprising:

determining, by the processor, an amount of fuel consumed during the period of operation of the work vehicle; and determining, by the processor, the amount of fuel consumed in each of the plurality of idle states based on the duration for each of the plurality of idle states over the period of operation of the work vehicle.

15. The method of claim 14, further comprising:

determining, by the processor, an amount of time spent by the work vehicle in each of the plurality of idle states based on the duration for each of the plurality of idle states over the period of operation.

16. The method of claim 10, further comprising receiving a status of a park brake associated with the work vehicle and a speed of the work vehicle, the plurality of idle states further comprise a break time idle state, and the determining of the break time idle state comprises determining a transition in the speed of the work vehicle and the status of the park brake.

17. The method of claim 10, wherein the receiving the one or more operational parameters of the work vehicle comprises receiving a weight of the payload from one of the sensors providing a source of payload data and the determining of the loading idle state by the processor comprises determining a transition in a weight of the payload.

18. The method of claim 10, wherein the receiving the one or more operational parameters of the work vehicle comprises receiving a speed of the work vehicle from one of the sensors providing a source of speed data and receiving a state of the engine; and wherein the determining of the warm up idle state by the processor comprises determining a transition in the engine state and determining a transition in the speed of the work vehicle.

19. An idle state determination system for a work vehicle having an engine and at least one movable work implement, the movable work implement including a load bin movable between loaded and unloaded positions by a hydraulic circuit, the load bin operable to receive a payload, and the idle state determination system comprising:

sensors associated with one or more of the engine, the load bin and the hydraulic circuit that provide signals containing work vehicle data that indicates one or more operational parameters of the work vehicle, the operational parameters including at least a speed of the work vehicle, a state of the engine, a weight of the payload and a state of the load bin;

a datastore device providing a source of idle state classifications that include a plurality of idle states associated with the work vehicle, the plurality of idle states including at least a warm-up idle state, a waiting to load idle state, a loading idle state, a waiting to dump idle state, a break time idle state and a cool-down idle state; and a controller that receives and processes the work vehicle data and is configured to:

receive the signals from the sensors;

determine an idle state of the work vehicle based on the work vehicle data;

communicate with the datastore device;

classify the determined idle state as one of the plurality of idle states contained in the datastore device;

determine a duration of the determined idle state based, at least in part, on the work vehicle data indicating a transition in at least one of the speed of the work vehicle, the weight of the payload and the state of the load bin; and transmit the duration for each of the plurality of idle states to a remote processing system.

20. The idle state determination system of claim 19, wherein the controller determines the waiting to dump idle state based on the speed of the work vehicle as below a speed threshold, a weight of the payload as above a first weight threshold and the state of the load bin; and wherein the controller receives a status of a park brake and determines the break time idle state based on the speed of the work vehicle as below a speed threshold and the status of the park brake.

* * * * *